US010590760B2

(12) United States Patent
Popp et al.

(10) Patent No.: US 10,590,760 B2
(45) Date of Patent: Mar. 17, 2020

(54) REAL-TIME MONITORING OF DOWNHOLE DYNAMIC EVENTS

(71) Applicants: Baker Hughes, Houston, TX (US); William Marsh Rice University, Houston, TX (US)

(72) Inventors: Timothy Michael Popp, Houston, TX (US); Holger Stibbe, Humble, TX (US); Polichronis-Thomas D. Spanos, Houston, TX (US)

(73) Assignees: BAKER HUGHES, A GE COMPANY, LLC, Houston, TX (US); WILLIAM MARSH RICE UNIVERSITY, Houston, TX (US)

( * ) Notice: Subject to any disclaimer, the term of this patent is extended or adjusted under 35 U.S.C. 154(b) by 122 days.

(21) Appl. No.: 15/860,806

(22) Filed: Jan. 3, 2018

(65) Prior Publication Data

US 2019/0203588 A1 Jul. 4, 2019

(51) Int. Cl.

| | |
|---|---|
| ***E21B 47/12*** | (2012.01) |
| *E21B 47/18* | (2012.01) |
| *E21B 47/14* | (2006.01) |

(52) U.S. Cl.

CPC ..... *E21B 47/12* (2013.01); *E21B 47/122* (2013.01); *E21B 47/14* (2013.01); *E21B 47/18* (2013.01)

(58) Field of Classification Search

CPC ..... E21B 47/12; E21B 47/122; E21B 47/18; E21B 47/14

See application file for complete search history.

(56) References Cited

U.S. PATENT DOCUMENTS

| | | | | |
|---|---|---|---|---|
| 5,138,875 | A | 8/1992 | Booer | |
| 5,721,376 | A | 2/1998 | Pavone et al. | |
| 2002/0124652 | A1* | 9/2002 | Schultz | E21B 12/02 73/587 |
| 2008/0232241 | A1* | 9/2008 | Proctor | H04B 7/15542 370/210 |
| 2013/0075159 | A1 | 3/2013 | Yang | |

FOREIGN PATENT DOCUMENTS

| | | | |
|---|---|---|---|
| CN | 1512032 | A | 7/2004 |

OTHER PUBLICATIONS

Bendat et al. "Engineering Applications of Correlation and Spectral Analysis", John Wiley & Sons, Inc. (1980) 5 pages.

International Search Report; International Application No. PCT/US2018/064911; Date of Filing Dec. 11, 2018; dated Apr. 1, 2019; 7 pages.

International Written Opinion; International Application No. PCT/US2018/064911; Date of Filing Dec. 11, 2018; dated Apr. 1, 2019; 8 pages.

(Continued)

*Primary Examiner* — Brad Harcourt

(74) *Attorney, Agent, or Firm* — Cantor Colburn LLP

(57) ABSTRACT

Methods and systems for conducting downhole operations including collecting downhole dynamic event data using a downhole tool, wherein the downhole dynamic event data is time-domain data, processing the collected downhole dynamic event data using a computing system located downhole to convert the time-domain data into frequency-domain data, and extracting digital filter coefficients from the frequency-domain data.

20 Claims, 12 Drawing Sheets

(56) References Cited

OTHER PUBLICATIONS

Mignolet, Marc P., et al., "Autoregressive Spectral Modeling: Difficulties and Remedies", Int. J. Non-Linear Mechanics, vol. 26, No. 6, 1991, pp. 911-930 (20 pp.).
Shinozuka, M., "Simulation of Multivariate and Multidimensional Random Processes", The Journal of the Acoustical Society of America, vol. 49, No. 1 (Part 2), 1971 (12 pp.).
Soong et al. "Random Vibration of Mechnical and Structural Systems", Englewood Cliffs, NJ, Prentice Hall, 1992; pp. 339-365.
Spanos, P.D., et al. "Efficient Iterative Arma Approximation of Multivariate Random Processes for Structural Dynamics Applications", Earthquake Engineering and Structural Dynamics, vol. 25, 1996, pp. 497-507 (11 pp.).
Spanos, Pol D., et al., "Low-Frequency Spectral Representation of Space Shuttle Flight Data", Journal of Aerospace Engineering, vol. 3, No. 2, Apr. 1990 (18 pp.).
Spanos, P-T. D., et al. "Linear Prediction Theory for Digital Simulation of Sea Waves", Journal of Energy Resources Technology, vol. 103, Sep. 1981 (7 pp.).
Spanos, P-T., D., "ARMA Algorithms for Ocean Wave Modeling", Journal of Energy Resources Technology, Transactions of the ASME, vol. 105, Sep. 1983 (10 pp.).

* cited by examiner

REAL-TIME MONITORING OF DOWNHOLE DYNAMIC EVENTS

BACKGROUND

1. Field of the Invention

The present invention generally relates to downhole operations and systems for monitoring downhole dynamic events.

2. Description of the Related Art

Downhole dynamic event data is of critical importance in downhole operations such as drilling, exploration, production, etc. Downhole dynamic event data can provide insight into the severity of downhole environmental conditions that are destructive to downhole tools. Additionally, downhole dynamic event (e.g., vibration, torques, bending moments, etc.) data may be correlated to various lithological properties leading to formation identification and/or geo-steering. For these reasons, visualizing downhole dynamic event data may help reduce non-productive time (NPT) and improve reservoir performance during drilling. Therefore, the real-time availability of downhole dynamic event data/information is advantageous for making cost effective drilling decisions.

Downhole dynamic event measurements typically take place within a bottomhole assembly (BHA), and recent technological advancements have enabled faster sampling rates and greater storage capacity of these measurements. However, most downhole dynamic event measurements are evaluated after the BHA assembly is tripped out of the hole and after the measurements are downloaded from various measuring and/or logging tools (e.g., measurement-while-drilling/logging-while-drilling tools). This is necessary because downhole dynamic event measurements capture time-domain records over extended periods of time, and current downhole data transmission technology is incapable of transmitting extensive time-domain downhole dynamic event measurements to the surface.

SUMMARY

Disclosed herein are systems and methods for conducting downhole operations including collecting downhole dynamic event data using a downhole tool, wherein the downhole dynamic event data is time-domain data, processing the collected downhole dynamic event data using a computing system located downhole to convert the time-domain data into frequency-domain data, and extracting digital filter coefficients from the frequency-domain data.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Figure 1:
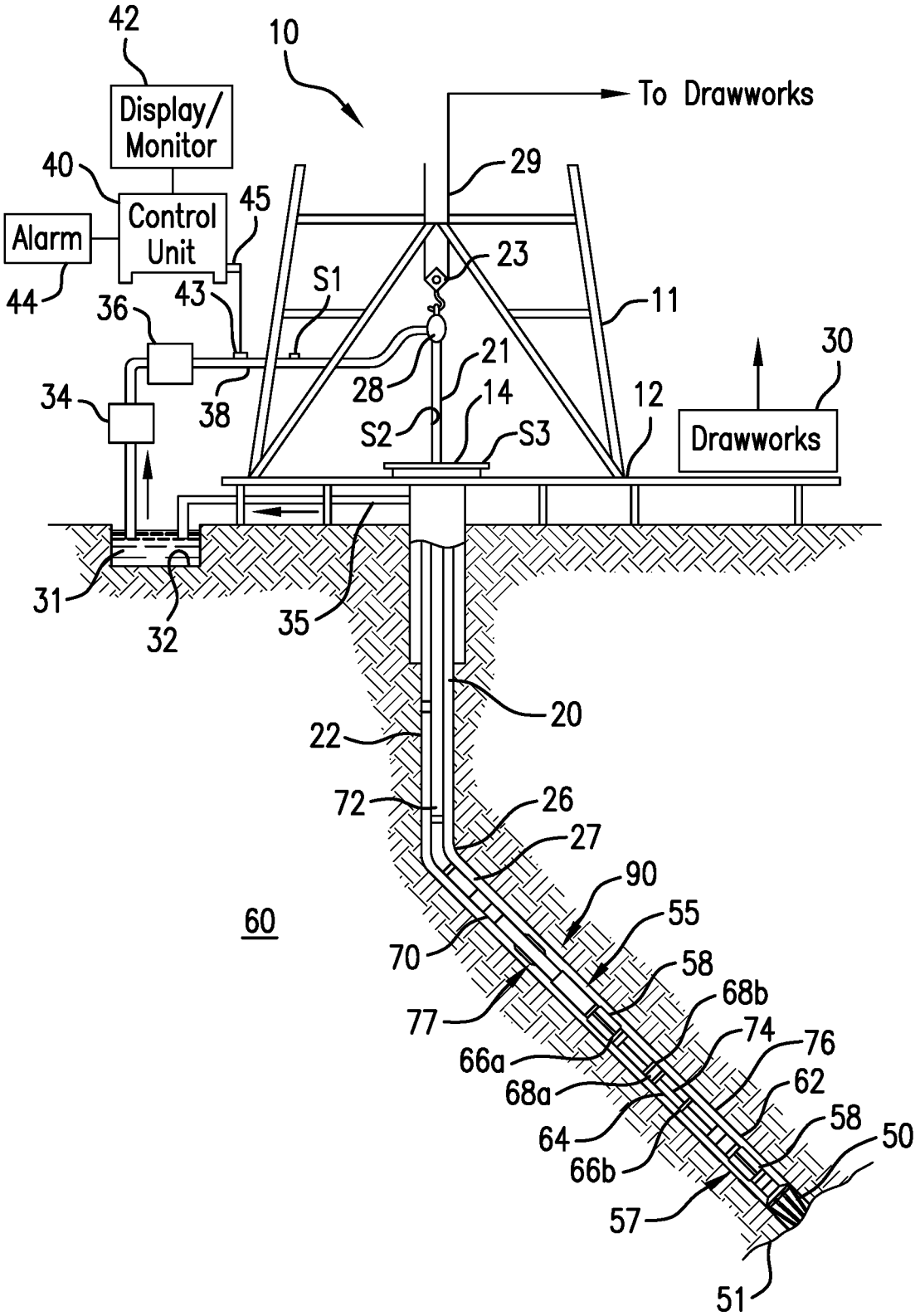
FIG. 1 is an example of a system for performing downhole operations that can employ embodiments of the present disclosure.

FIG. 1 shows a schematic diagram of a system for performing downhole operations. As shown, the system is a drilling system 10 that includes a drill string 20 having a drilling assembly 90, also referred to as a bottomhole assembly (BHA), conveyed in a borehole 26 penetrating an earth formation 60. The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A disintegrating tool 50, such as a drill bit attached to the end of the BHA 90, disintegrates the geological formations when it is rotated to drill the borehole 26.

The drill string 20 is coupled to surface equipment such as systems for lifting, rotating, and/or pushing, including, but not limited to, a drawworks 30 via a kelly joint 21, swivel 28 and line 29 through a pulley 23. In some embodiments, the surface equipment may include a top drive (not shown). During the drilling operations, the drawworks 30 is operated to control the weight on bit, which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes into the drill string 20 via a desurger 36, fluid line 38 and the kelly joint 21. The drilling fluid 31 is discharged at the borehole bottom 51 through an opening in the disintegrating tool 50. The drilling fluid 31 circulates uphole through the annular space 27 between the drill string 20 and the borehole 26 and returns to the mud pit 32 via a return line 35. A sensor 51 in the line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the borehole 26. The system may further include one or more downhole sensors 70 located on the drill string 20 and/or the BHA 90.

In some applications the disintegrating tool 50 is rotated by only rotating the drill pipe 22. However, in other applications, a drilling motor 55 (mud motor) disposed in the drilling assembly 90 is used to rotate the disintegrating tool 50 and/or to superimpose or supplement the rotation of the drill string 20. In either case, the rate of penetration (ROP) of the disintegrating tool 50 into the borehole 26 for a given formation and a drilling assembly largely depends upon the weight on bit and the drill bit rotational speed. In one aspect of the embodiment of FIG. 1, the mud motor 55 is coupled to the disintegrating tool 50 via a drive shaft (not shown) disposed in a bearing assembly 57. The mud motor 55 rotates the disintegrating tool 50 when the drilling fluid 31 passes through the mud motor 55 under pressure. The bearing assembly 57 supports the radial and axial forces of the disintegrating tool 50, the downthrust of the drilling motor and the reactive upward loading from the applied weight on bit. Stabilizers 58 coupled to the bearing assembly 57 and other suitable locations act as centralizers for the lowermost portion of the mud motor assembly and other such suitable locations.

A surface control unit 40 receives signals from the downhole sensors 70 and devices via a transducer 43, such as a pressure transducer, placed in the fluid line 38 as well as from sensors 51, S2, S3, hook load sensors, RPM sensors, torque sensors, and any other sensors used in the system and processes such signals according to programmed instructions provided to the surface control unit 40. The surface control unit 40 displays desired drilling parameters and other information on a display/monitor 42 for use by an operator at the rig site to control the drilling operations. The surface control unit 40 contains a computer, memory for storing data, computer programs, models and algorithms accessible to a processor in the computer, a recorder, such as tape unit, memory unit, etc. for recording data and other peripherals. The surface control unit 40 also may include simulation models for use by the computer to processes data according to programmed instructions. The control unit responds to user commands entered through a suitable device, such as a keyboard. The control unit 40 is adapted to activate alarms 44 when certain unsafe or undesirable operating conditions occur.

The drilling assembly 90 also contains other sensors and devices or tools for providing a variety of measurements relating to the formation surrounding the borehole and for drilling the borehole 26 along a desired path. Such devices may include a device for measuring the formation resistivity near and/or in front of the drill bit, a gamma ray device for measuring the formation gamma ray intensity and devices for determining the inclination, azimuth and position of the drill string. A formation resistivity tool 64, made according an embodiment described herein may be coupled at any suitable location, including above a lower kick-off subassembly 62, for estimating or determining the resistivity of the formation near or in front of the disintegrating tool 50 or at other suitable locations. An inclinometer 74 and a gamma ray device 76 may be suitably placed for respectively determining the inclination of the BHA and the formation gamma ray intensity. Any suitable inclinometer and gamma ray device may be utilized. In addition, an azimuth device (not shown), such as a magnetometer or a gyroscopic device, may be utilized to determine the drill string azimuth. Such devices are known in the art and therefore are not described in detail herein. In the above-described exemplary configuration, the mud motor 55 transfers power to the disintegrating tool 50 via a hollow shaft that also enables the drilling fluid to pass from the mud motor 55 to the disintegrating tool 50. In an alternative embodiment of the drill string 20, the mud motor 55 may be coupled below the resistivity tool 64 or at any other suitable place.

Still referring to FIG. 1, other logging-while-drilling (LWD) devices (generally denoted herein by numeral 77), such as devices for measuring formation porosity, permeability, density, rock properties, fluid properties, etc. may be placed at suitable locations in the drilling assembly 90 for providing information useful for evaluating the subsurface formations along borehole 26. Such devices may include, but are not limited to, temperature measurement tools, pressure measurement tools, borehole diameter measuring tools (e.g., a caliper), acoustic tools, nuclear tools, nuclear magnetic resonance tools and formation testing and sampling tools.

The above-noted devices transmit data to a downhole telemetry system 72, which in turn transmits the received data uphole to the surface control unit 40. The downhole telemetry system 72 also receives signals and data from the surface control unit 40 including a transmitter and transmits such received signals and data to the appropriate downhole devices. In one aspect, a mud pulse telemetry system may be used to communicate data between the downhole sensors 70 and devices and the surface equipment during drilling operations. A transducer 43 placed in the mud supply line 38 detects the mud pulses responsive to the data transmitted by the downhole telemetry 72. Transducer 43 generates electrical signals in response to the mud pressure variations and transmits such signals via a conductor 45 to the surface control unit 40. In other aspects, any other suitable telemetry system may be used for two-way data communication (e.g., downlink and uplink) between the surface and the BHA 90, including but not limited to, an acoustic telemetry system, an electro-magnetic telemetry system, an optical telemetry system, a wired pipe telemetry system which may utilize wireless couplers or repeaters in the drill string or the borehole. The wired pipe may be made up by joining drill pipe sections, wherein each pipe section includes a data communication link that runs along the pipe. The data connection between the pipe sections may be made by any suitable method, including but not limited to, hard electrical or optical connections, induction, capacitive, resonant coupling, or directional coupling methods. In case a coiled-tubing is used as the drill pipe 22, the data communication link may be run along a side of the coiled-tubing.

The drilling system described thus far relates to those drilling systems that utilize a drill pipe to conveying the drilling assembly 90 into the borehole 26, wherein the weight on bit is controlled from the surface, typically by controlling the operation of the drawworks. However, a large number of the current drilling systems, especially for drilling highly deviated and horizontal boreholes, utilize coiled-tubing for conveying the drilling assembly downhole. In such application a thruster is sometimes deployed in the drill string to provide the desired force on the drill bit. Also, when coiled-tubing is utilized, the tubing is not rotated by a rotary table but instead it is injected into the borehole by a suitable injector while the downhole motor, such as mud motor 55, rotates the disintegrating tool 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* and/or receivers 68*a* or 68*b*. Resistivity can be one formation property that is of interest in making drilling decisions. Those of skill in the art will appreciate that other formation property tools can be employed with or in place of the resistivity tool 64.

Liner drilling can be one configuration or operation used for providing a disintegrating device becomes more and more attractive in the oil and gas industry as it has several advantages compared to conventional drilling. One example of such configuration is shown and described in commonly owned U.S. Pat. No. 9,004,195, entitled "Apparatus and Method for Drilling a Borehole, Setting a Liner and Cementing the Borehole During a Single Trip," which is incorporated herein by reference in its entirety. Importantly, despite a relatively low rate of penetration, the time of getting the liner to target is reduced because the liner is run in-hole while drilling the borehole simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

Although FIG. 1 is shown and described with respect to a drilling operation, those of skill in the art will appreciate that similar configurations, albeit with different components, can be used for performing different downhole operations. For example, wireline, coiled tubing, and/or other configurations can be used as known in the art. Further, production configurations can be employed for extracting and/or injecting materials from/into earth formations. Thus, the present disclosure is not to be limited to drilling operations but can be employed for any appropriate or desired downhole operation(s).

Figure 2:
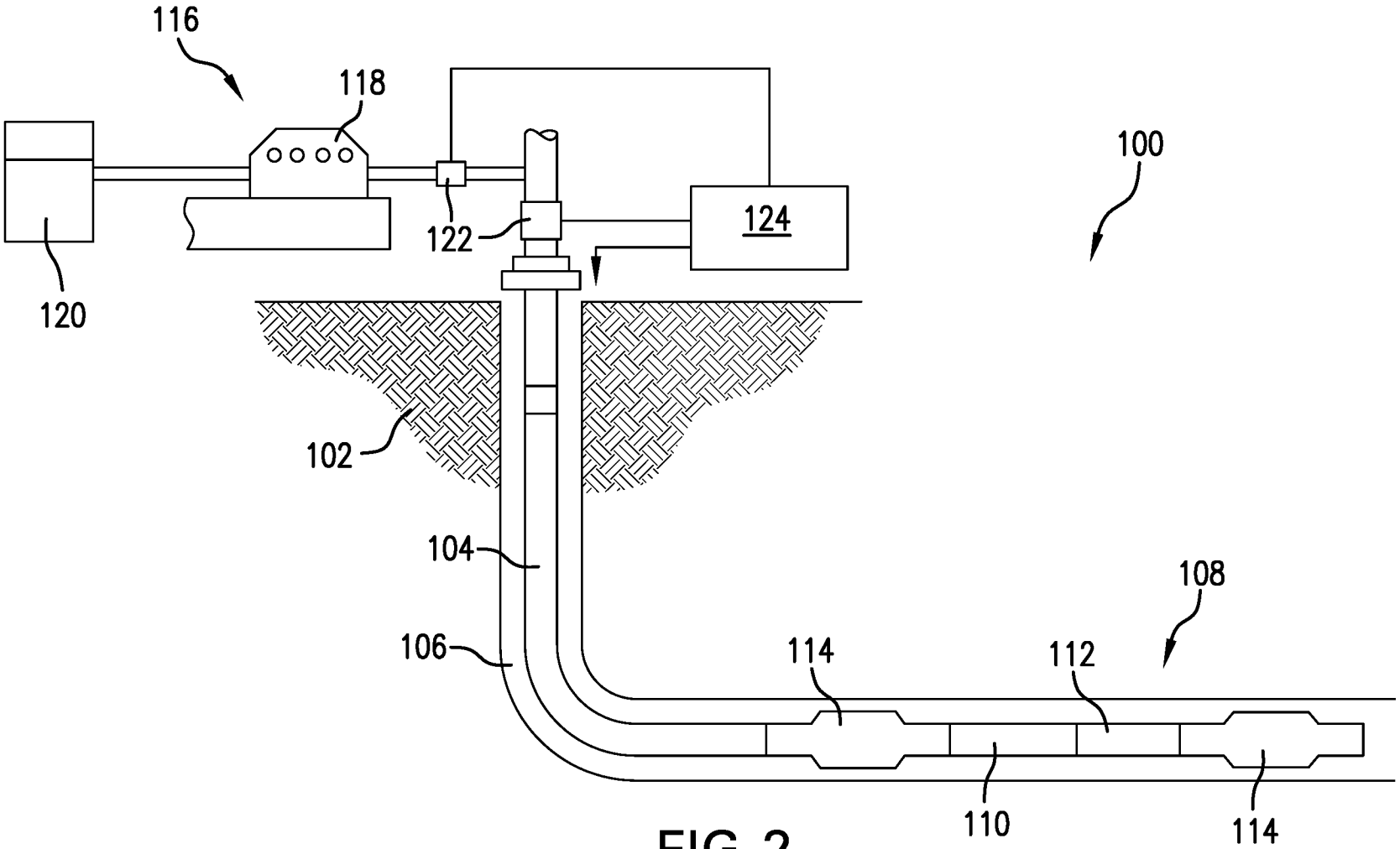
FIG. 2 depicts a system for formation stimulation and hydrocarbon production that can incorporate embodiments of the present disclosure.

Turning to FIG. 2, a schematic illustration of an embodiment of a system 100 for hydrocarbon production and/or evaluation of an earth formation 102 that can employ embodiments of the present disclosure is shown. The system 100 includes a borehole string 104 disposed within a borehole 106. The string 104, in one embodiment, includes a plurality of string segments or, in other embodiments, is a continuous conduit such as a coiled tube. As described herein, "string" refers to any structure or carrier suitable for lowering a tool or other component through a borehole or connecting a drill bit to the surface, and is not limited to the structure and configuration described herein. The term "carrier" as used herein means any device, device component, combination of devices, media, and/or member that may be used to convey, house, support, or otherwise facilitate the use of another device, device component, combination of devices, media, and/or member. Example, non-limiting carriers include, but are not limited to, casing pipes, wirelines, wireline sondes, slickline sondes, drop shots, downhole subs, bottomhole assemblies, and drill strings.

In one embodiment, the system 100 is configured as a hydraulic stimulation system. As described herein, "stimulation" may include any injection of a fluid into a formation. A fluid may be any flowable substance such as a liquid or a gas, or a flowable solid such as sand. In such embodiment, the string 104 includes a downhole assembly 108 that includes one or more tools or components to facilitate stimulation of the formation 102. For example, the string 104 includes a fluid assembly 110, such as a fracture or "frac" sleeve device or an electrical submersible pumping system, and a perforation assembly 112 (e.g., a fracturing assembly). Examples of the perforation assembly 112 include shaped charges, torches, projectiles, and other devices for perforating a borehole wall and/or casing. The string 104 may also include additional components, such as one or more isolation or packer subs 114.

One or more of the downhole assembly 108, the fluid assembly 110, the perforation assembly 112, and/or the packer subs 114 may include suitable electronics or processors configured to communicate with a surface processing unit and/or control the respective tool or assembly.

A surface system 116 can be provided to extract material (e.g., fluids) from the formation 102 or to inject fluids through the string 104 into the formation 102 for the purpose of fraccing.

As shown, the surface system 116 includes a pumping device 118 in fluid communication with a tank 120. In some embodiments, the pumping device 118 can be used to extract fluid, such as hydrocarbons, from the formation 102, and store the extracted fluid in the tank 120. In other embodiments, the pumping device 118 can be configured to inject fluid from the tank 120 into the string 104 to introduce fluid into the formation 102, for example, to stimulate and/or fracture the formation 102.

One or more flow rate and/or pressure sensors 122, as shown, are disposed in fluid communication with the pumping device 118 and the string 104 for measurement of fluid characteristics. The sensors 122 may be positioned at any suitable location, such as proximate to (e.g., at the discharge output) or within the pumping device 118, at or near a wellhead, or at any other location along the string 104 and/or within the borehole 106.

A processing and/or control unit 124 is disposed in operable communication with the sensors 122, the pumping device 118, and/or components of the downhole assembly 108. The processing and/or control unit 124 is configured to, for example, receive, store, and/or transmit data generated from the sensors 122 and/or the pumping device 118, and includes processing components configured to analyze data from the pumping device 118 and the sensors 122, provide alerts to the pumping device 118 or other control unit and/or control operational parameters, and/or communicate with and/or control components of the downhole assembly 108. The processing and/or control unit 124 includes any number of suitable components, such as processors, memory, communication devices and power sources.

As discussed above, downhole dynamic event data is of critical importance in downhole operations such as drilling, exploration, production, etc. As used herein, downhole dynamic events include vibrations, forces, torques, bending moments, etc. Downhole dynamic event data can provide insight into the severity of downhole environmental conditions that are destructive to downhole tools. Downhole dynamic event data may be correlated to various lithological properties leading to formation identification and/or geo-steering. For these reasons, visualizing downhole dynamic event data may help reduce non-productive time (NPT) and improve reservoir performance during drilling. Therefore, the real-time availability of downhole dynamic event data/information is advantageous for making cost effective drilling decisions.

Downhole dynamic event measurements typically take place within a BHA, and recent technological advancements have enabled faster sampling rates and greater storage capacity of these measurements. However, most downhole dynamic event measurements are evaluated after the BHA assembly is tripped out of the hole and after the measurements are downloaded from various measuring and/or logging tools (e.g., measurement-while-drilling/logging-while-drilling tools). This is necessary because downhole dynamic event measurements capture time-domain records over extended periods of time, and current downhole data transmission technology is incapable of transmitting extensive time-domain downhole dynamic event measurements to the surface.

In view of the above, embodiments provided here are directed to employing frequency-domain downhole dynamic event information, as compared to time-domain information. A frequency spectrum can be used, in accordance with embodiments of the present disclosure, to enable ease of data transmission while also enabling accurate information extraction at a remote computing system, such as a surface control unit. Downhole dynamic event data is obtained from the measuring and/or logging tools (e.g., measurement-while-drilling and/or logging-while-drilling tools) as time-domain data, but is transformed from time-domain data to frequency-domain data. Historically, the conversion from time-domain to frequency-domain is accomplished through the Fourier Transform (or Fast-Fourier Transform with digital signals). An alternative and efficient method for representing time-domain data in terms of the frequency content is to utilize digital filters, including, but not limited to, Auto-regressive (AR), Moving-average (MA), and Auto-regressive Moving-average (ARMA) filters.

In operation, embodiments of the present disclosure are directed to collecting downhole dynamic event data at or with a downhole tool. Such downhole dynamic event data includes measured vibrations, forces, torques, bending moments, etc. The downhole dynamic event data can be collected from one or more downhole detectors, sensors, measurement devices, logging devices, etc. The data is collected in real-time at one or more control elements (e.g., processors and memory devices located in a downhole tool). As noted, typically the amount of downhole dynamic event data collected is too large to be transmitted in a real-time basis, and thus the downhole dynamic event data is typically stored on memory within the downhole tool, and then the downhole dynamic event data is collected when the downhole tool is brought back to the surface after tripping out of the borehole.

However, by having to wait until the downhole tool is tripped to the surface, real-time reactions to downhole events cannot be achieved. Thus, improved mechanisms and processes for collecting and/or transmitting data in real-time are provided in accordance with embodiment of the present disclosure. For example, in some embodiments, rather than transmitting all data in real time, embodiments provided herein are directed to taking real-time data and compressing it into more manageable data that can be used to recreate the real-time data. The compressed data can then be stored in reduced data sizes (e.g., occupy less memory space) and/or transmitted as smaller transmission packets that are easier to transmit in real time. Embodiments provided herein are directed to converting time-domain data into spectrum coefficients that can be used to reconstruct the time-domain data at a later time.

Although spectrum coefficients may take the form of Fourier coefficients, Auto-regressive (AR), Moving-average (MA), or Auto-regressive Moving-average (ARMA) coefficients, the methods described herein, convey the most efficient means to compress time-domain data to a set of digital filter coefficient(s) which may then be transmitted in real-time during drilling (and/or saved in tool memory) are provided. The digital filter coefficients, once received at a remote computing system, such as at the surface, can be used to recreate a downhole dynamic event spectrum and enables synthesizing artificial time-histories that are compatible with the downhole dynamic event spectrum. Retrieval of the digital filter coefficients can be achieved through real-time transmission from a downhole tool to a remote (e.g., surface) computer, delayed transmission, and/or by downhole digital storage and later extraction or download from a downhole tool that is tripped from a borehole. Ultimately, these spectral representations and artificial time histories can provide insight into drilling optimization decisions and diagnostic/prognostic studies on tool life.

More specifically, through the use of AR, MA, ARMA, and/or FFT digital filters, downhole time-domain dynamic event data can be efficiently represented in terms of its spectrum. For example, AR- and ARMA-coefficients are two example types of digital filter coefficients that may be employed in embodiments of the present disclosure. In compact form, these digital filter coefficients can be transmitted, during real-time drilling, to a remote computing system, such as at the surface, where the AR- and ARMA-coefficients reproduce the downhole dynamic event spectrum. In other embodiments, the digital filter coefficients can be easily stored in memory of downhole digital storage for later retrieval. Such storage can save memory storage space. The digital filter coefficients can additionally be used to synthesize artificial realizations that are compatible with the downhole dynamic event spectra. The approximate spectra and artificial time-histories may be utilized for system identification, lithology detection, geo-steering, diagnostic/prognostic studies and downhole system life and wear studies.

The first stage of the method begins with an AR digital filter. A transfer function of a p-order AR digital filter is represented by the following z-transform:

$$H_{AR}(z) = \frac{G}{1 + \sum_{k=1}^{p} a_k z^{-k}} \tag{1}$$

In equation (1), G is a scaling factor, and $a_k$ are the AR-coefficients. The output power spectrum of the digital filter can easily be represented as the modulus of the transfer function. This power spectrum is the approximation spectrum of the downhole dynamic event data:

$$S_{AR}(\omega)=H_{AR}(e^{i\omega T})H^*_{AR}(e^{i\omega T}) \tag{2}$$

The sampling time, T, is defined as π divided by a predefined cutoff frequency $\omega_b$.

$$T = \frac{\pi}{\omega_b} \tag{3}$$

All that is needed to reproduce the spectrum of the time record, according to equation (1), are the AR-coefficients, $a_k$, and the scaling factor, G. By minimizing the error between a target power spectrum and an approximation spectrum, the digital filter coefficients are found. The minimizing criterion results in a linear system which can be represented by the Toeplitz matrix equation. The error criterion is defined as:

$$E_{AR} = \int_{-\omega_b}^{\omega_b} \frac{S(\omega)}{S_{AR}(\omega)} d\omega = \text{minimum, such that } 0 \le |\omega| \le \omega_b \tag{4}$$

This minimization criterion yields the Toeplitz matrix equation consisting of the auto-covariance values, $R_\lambda$, and digital filter coefficients, $a_k$.

$$\begin{bmatrix} R_0 & R_1 & R_2 & R_{p-1} \\ R_1 & R_0 & \dots & R_{p-2} \\ R_2 & R_1 & \dots & R_{p-3} \\ \vdots & \vdots & & \vdots \\ R_{p-1} & R_{p-2} & \dots & R_0 \end{bmatrix} \begin{bmatrix} a_1 \\ a_2 \\ \vdots \\ \vdots \\ a_p \end{bmatrix} = -\begin{bmatrix} R_1 \\ R_2 \\ \vdots \\ \vdots \\ R_p \end{bmatrix} \tag{5}$$

For digital time-domain records, the auto-covariance values are found using the following equation:

$$R_\lambda = \frac{\sum_{i=1}^{n} x_i(t)x_i(t+\lambda T)}{n} \tag{6}$$

Alternatively, if a continuous spectrum definition is provided, the auto-covariance values may be determined from the following integral:

$$R_\lambda=2\int_0^{\omega_b} S(\omega)\cos(\lambda T)d\omega \tag{7}$$

Once the auto-covariance values are obtained, from either Equation (6) or Equation (7), the Toeplitz matrix is populated and easily solved for the digital filter coefficients, $a_k$, using one of numerous linear algebra solving methods. Immediately upon solving the system for the digital filter coefficients, the scaling constant, G, is found from the auto-covariance values and digital filter coefficients.

$$G = \sqrt{\frac{R_0 + \sum_{k=1}^{p} a_k R_k}{2w_b}} \tag{8}$$

Once the digital filter coefficients, $a_k$, are known and the scaling constant, G, is known, the approximate spectrum can be generated from Equation (2). Thus:

$$S(\omega) \approx S_{AR}(\omega) = \frac{G^2}{\left(1 + \sum_{k=1}^{p} a_k z^{-k}\right)^2} \tag{9}$$

To reproduce the downhole dynamic event spectrum, only the AR-coefficients $a_k$ and the scaling constant G are needed. These values may be transmitted to a remote computing system, such as at the surface, during drilling using any given method, as will be appreciated by those of skill in the art (e.g., mud-pulse telemetry, wired pipe, etc.). In addition, or alternatively, the values can be stored in digital memory of a downhole tool.

In addition to the spectral representation, time histories compatible with the approximation spectrum, which is closely equivalent to the target spectrum, may be synthesized. Well-established and popular random number generator algorithms can be used to generate white noise deviates, Wn, which are scaled by the square root of the cutoff frequency, after which all values are needed for the following synthetic time record difference equation:

$$s_n = \begin{cases} 0, & n < 0 \\ GW_n - \sum_{k=1}^{p} a_k s_{n-k}, & n \ge 0 \end{cases} \tag{10}$$

The synthetic realizations may be constructed using a remote computing system, such as a surface controller or control unit, which elucidate time-dependent downhole dynamic event taking place downhole in real-time. In some embodiments, a high-order filter may be used to obtain the AR spectral representation with sharp peaks, which may result in numerous AR-coefficients. Too many necessary digital filter coefficients could limit transmission to the remote computing system (or may require too much digital memory storage space). In light of this, in accordance with some embodiments, the generated AR-coefficients can be employed in conjunction with an ARMA filter. The advantage of this method is that a higher order AR method may be implemented to account for sharp peaks of the spectra, and then a lower order ARMA model, with fewer digital filter coefficients, may be established to limit data transmitted to the remote computing system and/or limit the amount of data recorded on downhole memory storage elements. Using the ARMA-method, the spectral content is approximated from the following equation:

$$S(\omega) \approx S_{ARMA}(\omega) = \frac{\left(d_0 + \sum_{k=1}^{m} d_k z^{-k}\right)^2}{\left(1 + \sum_{k=1}^{m} c_k z^{-k}\right)^2} \tag{11}$$

The ARMA-coefficients, $c_k$ and $d_k$, are found from the auto-covariance values, previously defined in Equation (6) and Equation (7), and the cross-covariance values. These values form a linear system that is easily solved:

$$R * \begin{bmatrix} d_1 \\ d_2 \\ \vdots \\ d_m \\ c_1 \\ c_2 \\ \vdots \\ c_m \end{bmatrix} = - \begin{bmatrix} R_{vw}(1) \\ R_{vw}(2) \\ \vdots \\ R_{vw}(m) \\ R_{vv}(1) \\ R_{vv}(2) \\ \vdots \\ R_{vv}(m) \end{bmatrix} \tag{12}$$

The matrix R is composed of four sub-matrices that include values of auto-covariance, cross-covariance, and twice the cutoff frequency.

$$R = \begin{bmatrix} A & B \\ C & D \end{bmatrix} \tag{13}$$

The partitions are described by the following matrices:

$$A = \begin{bmatrix} 2\omega_b & 0 & \dots & 0 \\ 0 & 2\omega_b & \dots & 0 \\ \dots & \dots & & \dots \\ 0 & 0 & \dots & 2\omega_b \end{bmatrix} \tag{14}$$

$$B = \begin{bmatrix} -R_{vw}(0) & 0 & \dots & 0 \\ -R_{vw}(1) & -R_{vw}(0) & \dots & 0 \\ \dots & \dots & & \dots \\ -R_{vw}(m-1) & -R_{vw}(m-2) & \dots & -R_{vw}(0) \end{bmatrix}$$

$$C = \begin{bmatrix} R_{vw}(0) & R_{vw}(1) & \dots & R_{vw}(m-1) \\ 0 & R_{vw}(0) & \dots & R_{vw}(m-2) \\ \dots & \dots & & \dots \\ 0 & 0 & \dots & R_{vw}(0) \end{bmatrix}$$

$$D = \begin{bmatrix} -R_0 & -R_1 & \dots & -R_{m-1} \\ -R_1 & -R_0 & \dots & -R_{m-2} \\ \dots & \dots & & \dots \\ -R_{m-1} & -R_{m-2} & \dots & -R_0 \end{bmatrix}$$

The linear system is solved for the ARMA-coefficients in Equation (12), which in turn are used to reconstruct the approximate downhole dynamic event spectrum in Equation (11). Similar to the AR-method, the ARMA-coefficients may also be utilized to synthesize realizations that are compatible with the downhole dynamic event spectra from the recursive relationship which uses a linear combination of previous values and a linear combination of white noise deviates.

$$s_n = \begin{cases} 0, & n < 0 \\ \sum_{k=1}^{m} c_k s_{n-k} + \sum_{k=0}^{m} d_k W_{n-k}, & n \geq 0 \end{cases} \tag{15}$$

The advantage of the two step AR-ARMA-method over the AR-method for representing the spectrum is that the ARMA-method requires fewer digital filter coefficients and the information can therefore be stored easily and/or transmitted more easily and rapidly to the remote computing system, even to the surface. However, because the ARMA-model is generated from the AR-coefficients, a high order AR-method may be employed first to capture the quality and accuracy of the spectral content from the downhole dynamic event time histories. Once the ARMA-coefficients are transmitted to the remote computing system or extracted after tripping from the borehole, the spectrum of the downhole dynamic event can be easily created from the equations shown and described herein. Changes in spectral content may be correlated to formation detection (i.e., changes from one zone to another), wear- or crack-detection in BHA tools, downhole dynamic event severity (e.g., grms levels, stick-slip, whirl, etc.), and/or other downhole properties, characteristics, etc. On the surface, compatible time histories may be synthesized that match downhole spectrum in order to determine downhole dynamic event amplitudes and cyclic loading. Furthermore, realizations may also serve as inputs for Monte Carlo studies to provide real-time diagnostic and prognostic analysis on BHA life in the hole.

In some embodiments, a moving average (MA) digital filter can be employed, either in combination and/or as an alternative to other embodiments described herein. As with the AR-digital filter, an MA-digital filter (of q-order) may be described by its transfer function which is represented by the following z-transform:

$$H_{MA}(z) = \Sigma_{k=-q}^{q} b_k z^{-k} \tag{16}$$

The z-transform represents a non-recursive filter, where the coefficients, $b_k$, constitute the MA-coefficients. In the same fashion as the AR-method described above, the approximation spectrum of the MA filter is described according to:

$$S_{MA}(\omega) = H_{MA}(e^{i\omega T}) H^*_{MA}(e^{i\omega T}) \tag{17}$$

The quality of the spectrum approximation is determined by the minimum error:

$$E_{MA,min} = \Sigma_{|k|>q} |b_k|^2 < \infty \tag{18}$$

The minimum error, $E_{MA,min}$, is found by the minimization criterion, which is similar to the criterion in the AR-method. The minimization criterion for the MA-method is found by the equation:

$$E_{MA} = \frac{1}{2w_b} \int_{-w_b}^{w_b} \left| \sqrt{S(\omega)} - H_{MA}(e^{-i\omega T}) \right|^2 d\omega = \text{minimum} \tag{19}$$

From this minimization criterion, the MA-coefficients are also found:

$$b_k = \frac{1}{w_b} \int_0^{w_b} \sqrt{S(\omega)} \cos(kT\omega) d\omega \tag{20}$$

The MA-coefficients may then be used in the non-recursive filter in Equations (16) and (17) to yield the approximation spectrum for the MA-method. Additionally, synthetic time realizations may be generated with the same MA-coefficients, and white noise deviates ($W_n$):

$$s_n = \Sigma_{k=-q}^{q} b_k W_{n-k}, q \to \infty \tag{21}$$

The MA-coefficients and MA-synthetic realizations may be used in the same manner as the AR- and ARMA-methods. However, as the previous description suggests, the two-stage AR-ARMA method is the most efficient method to use for this application, but it does not preclude the use of the MA method in addition to, or instead of, the AR- or ARMA-methods.

The above described process enables reduction of time-domain data into digital filter coefficients for AR-, ARMA-, and/or MA-spectral models. Such digital filter coefficients are much smaller in terms of data size, which enables transmission to the surface in real-time or near-real-time such that a surface operator can reconstruct a time-domain signal based on the received AR-, ARMA-, and/or MA-coefficients. With the reconstructed time-domain signal, the operator can make substantially real-time decisions based on downhole conditions, rather than waiting for one or more downhole tools to be tripped from the borehole. Similarly, the reduced data size achieved by the digital filter coefficients can enable ease of storage in downhole tool digital memory that can be later extracted after tripping from a borehole.

Figure 3:
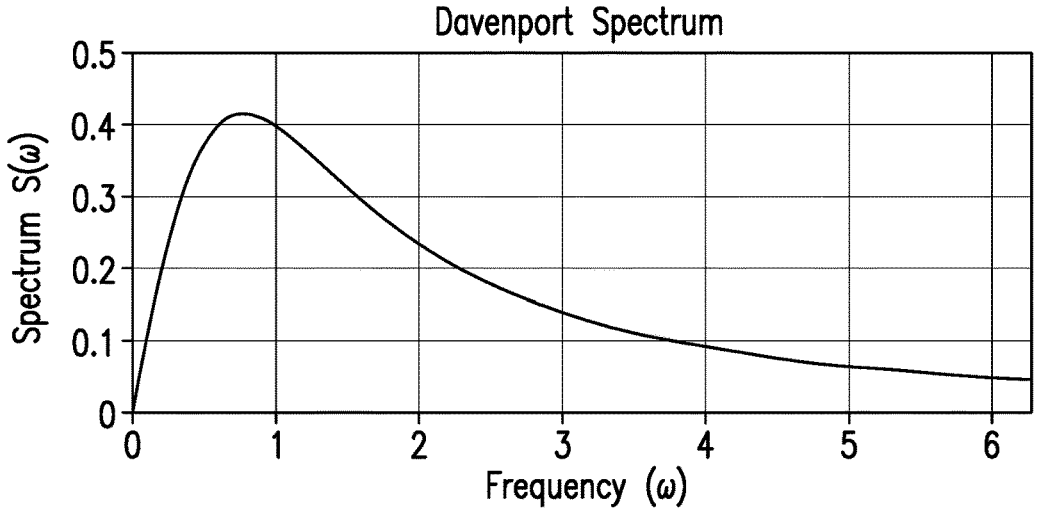
FIG. 3 is an example target spectrum used in an example of application of an embodiment of the present disclosure.

For example, shown in FIG. 3 is an example target spectra that is used to exhibit the functionality of the spectral approximation of the present disclosure and to illustrate an example application of the above described process. The test spectrum is a Davenport spectrum with a cutoff frequency of $2\pi$ (the Davenport spectrum is often used to represent wind loading on offshore structures). The mathematical representation of the Davenport target spectrum is:

$$S_T(\omega) = \frac{|\omega|}{(1+\omega^2)^{4/3}} \tag{22}$$

Figure 4:
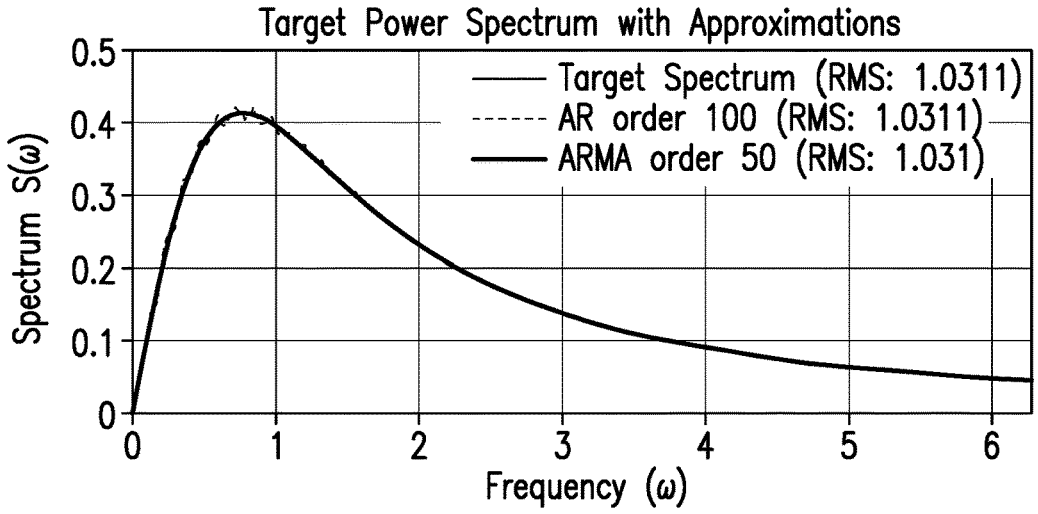
FIG. 4 is a plot showing the target spectrum of FIG. 3 and inclusion of approximations obtained in accordance with an embodiment of the present disclosure.
Figure 5:
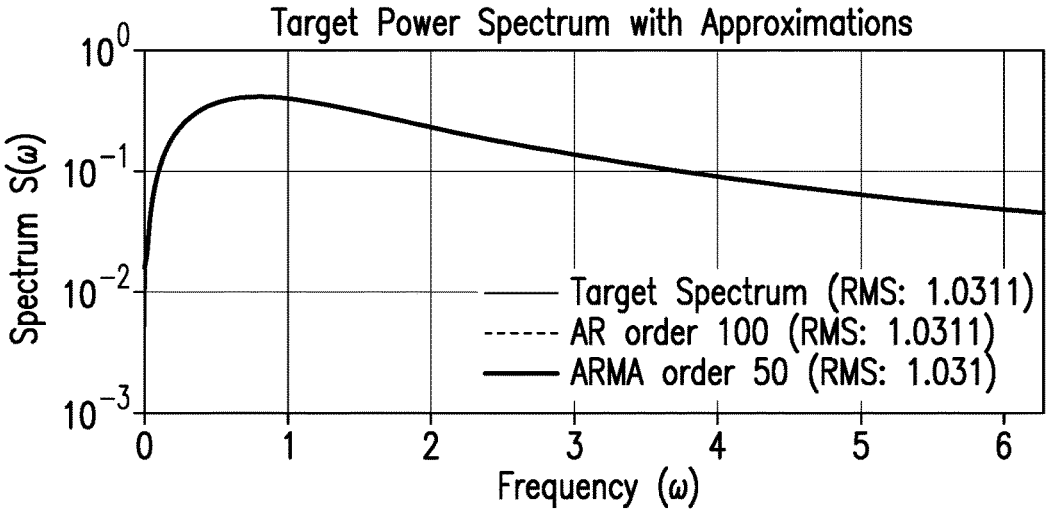
FIG. 5 is a plot of a Log scale spectrum with approximations obtained in accordance with an embodiment of the present disclosure.

The AR- and ARMA-methods described above are employed to approximate the Davenport target spectrum and to synthesize compatible time histories. Equations (1)-(15) described above are used with Equations (9) and (11) to yield an approximation spectra. An AR-approximation of order 100 and an ARMA-approximation of order 50 are plotted against the target spectrum, as shown in FIGS. 4-5. As will be appreciated by those of skill in the art, the AR-approximation and ARMA-approximations match well with the target spectrum. As is apparent in FIG. 4, the AR-approximation method includes frequency fluctuations at order 100 around the peak of the spectrum when the slope approaches zero. The error of the AR-approximation reduces as the order of the filter is increased, but may require a very high order to greatly minimize the fluctuations. However, as is apparent to those of skill in the art, the combination of an AR-filter of order 100 and an ARMA-filter of order 50 enables minimization and/or complete elimination of the fluctuations. Accordingly, as illustrated, the benefits of a two-stage AR-ARMA-method are readily appreciated. For example, as described above, a higher order (e.g., 100) AR-approximation proceeded by a lower order (e.g., 50) ARMA-approximation increase approximation accuracy while simultaneously requiring fewer digital filter coefficients.

Figure 6:
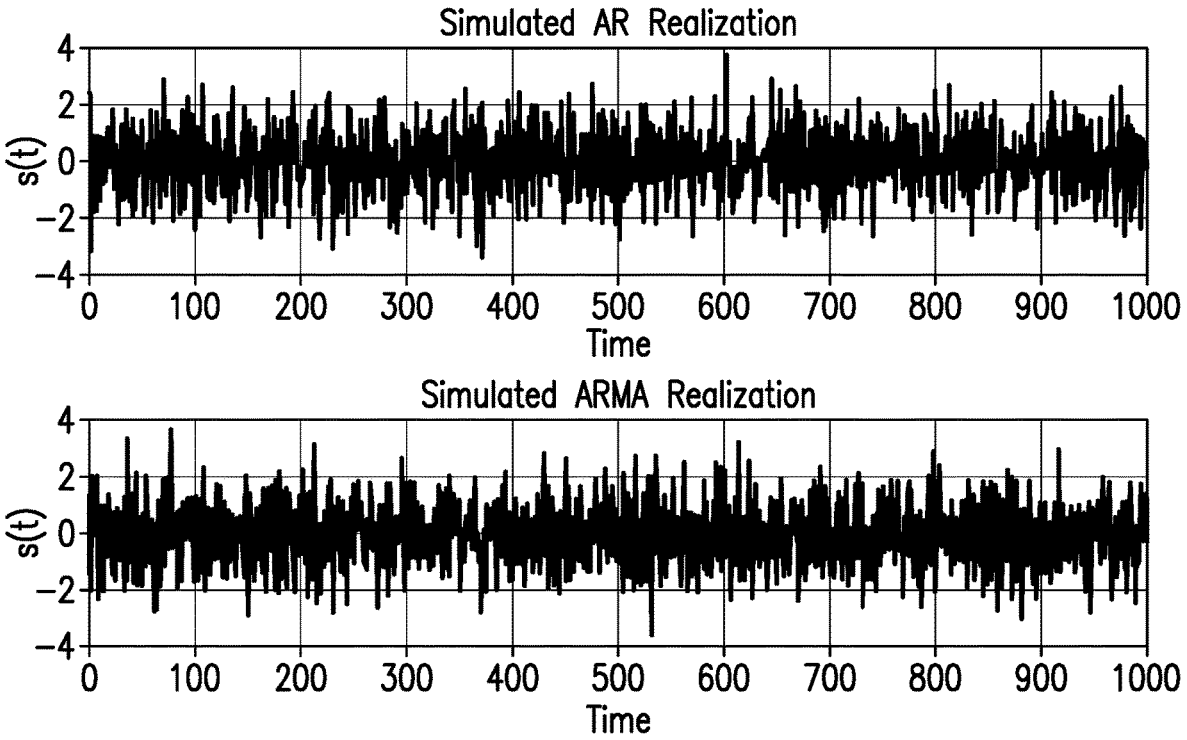
FIG. 6 is a pair of plots of synthetic time histories compatible with the target spectrum of FIG. 3.
Figure 7:
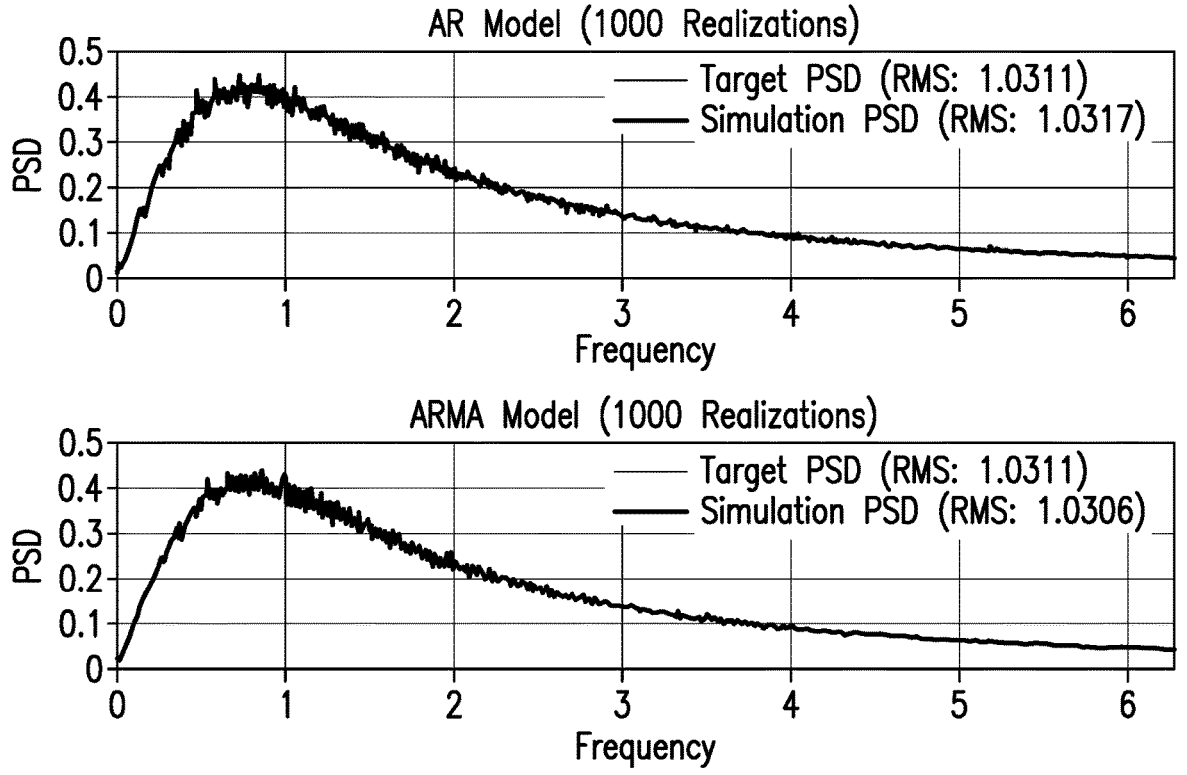
FIG. 7 is a pair of plots illustrating the target spectrum approximation computed from an ensemble of compatible time histories in accordance with an embodiment of the present disclosure.

The digital filter coefficients found in Equation (7) are utilized with the recursive equations introduced by Equation (10) to produce synthetic realizations. Compatibility of the realizations is verified by computing the average spectrum of the ensemble and then comparing the approximation spectrum with the target spectrum. FIGS. 6-7 illustrate a sample time history, from the ensemble, for the AR- and ARMA-approximations and the corresponding spectra from the ensembles. FIG. 6 is a synthetic time history that is compatible with the Davenport target spectrum and FIG. 7 are Davenport AR and ARMA approximation spectra computed from the ensemble of compatible time histories. Spectra are evaluated from the ensemble realizations and averaged to produce the approximation spectrum. In this example, the ensemble consists of 1,000 synthetic realizations. The synthetic time histories are proven to be compatible with the target Davenport spectrum as shown by the root-mean-square (rms) values (shown in FIG. 7). Further accuracy can be achieved by obtaining or requiring more realizations to compute the spectrum.

As demonstrated above, the AR- and ARMA-methods can provide reliable reconstruction of spectra. Such methods thus can be used to enable efficient transmission from a downhole tool to a remote computing system, such as at the surface, by transmitting only AR- and/or ARMA-coefficients. Similarly, such methods can improve data collection and downhole storage of data due to reduced data quantities and sizes collected. Time-spectra can then be reconstructed from the transmitted or stored digital filter coefficients.

To illustrate the application of the method for a downhole dynamic event, such as vibration, a sample vibration record will now be illustrated. In the present example, it is assumed that the time record is of one single data set of downhole vibration (in g's). In this example, an ensemble of one hundred vibration records is taken from the same vibration process, and the average spectrum from the ensemble constitutes the target spectrum for which the ARMA-method will be employed to approximate. Once the ARMA-coefficients are obtained from the target spectrum, the approximate spectrum is generated, and time histories compatible with the target spectrum are synthesized.

Figure 8:
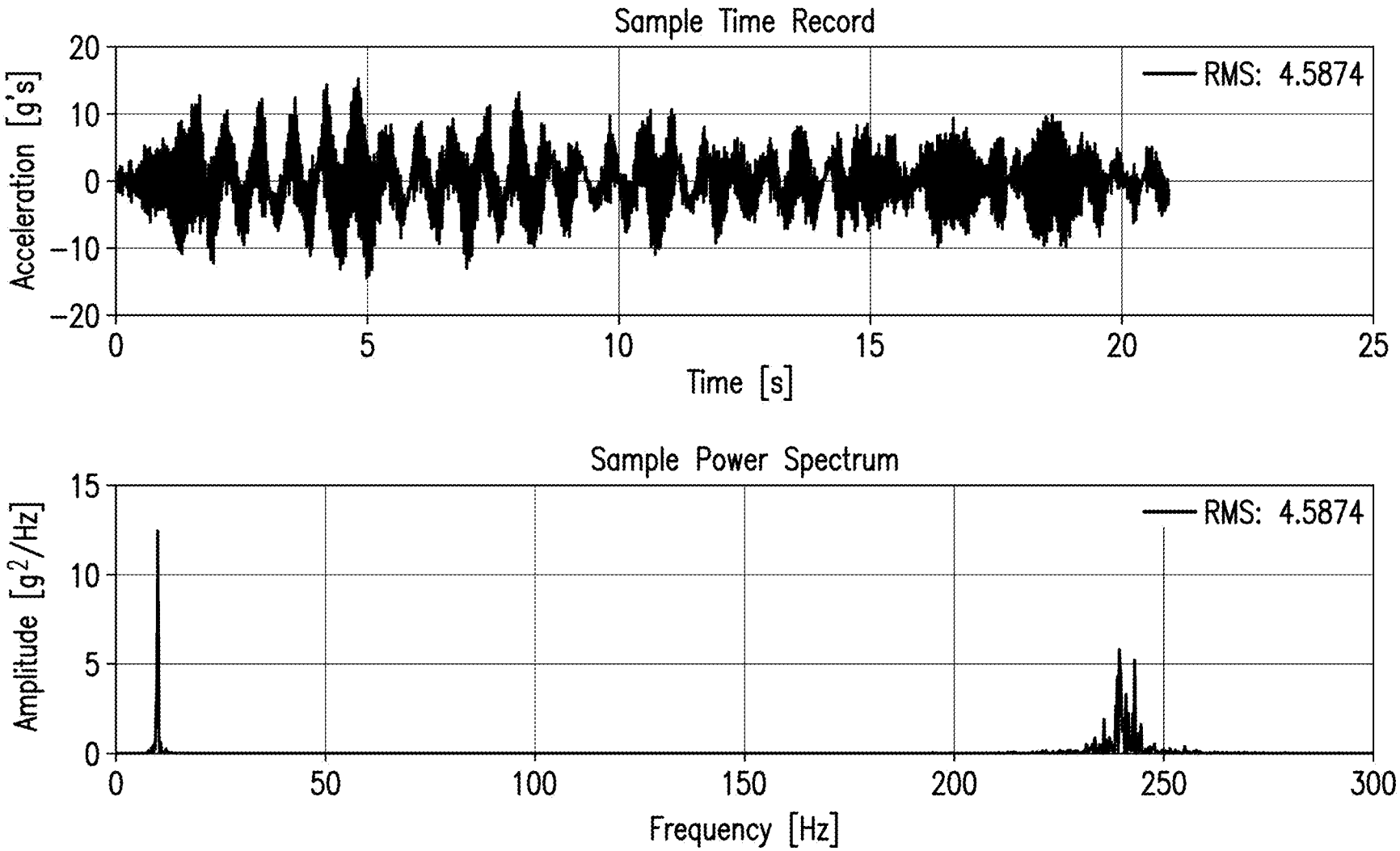
FIG. 8 is a pair of plots illustrating an example of a vibration time record and an associated power spectrum.
Figure 9:
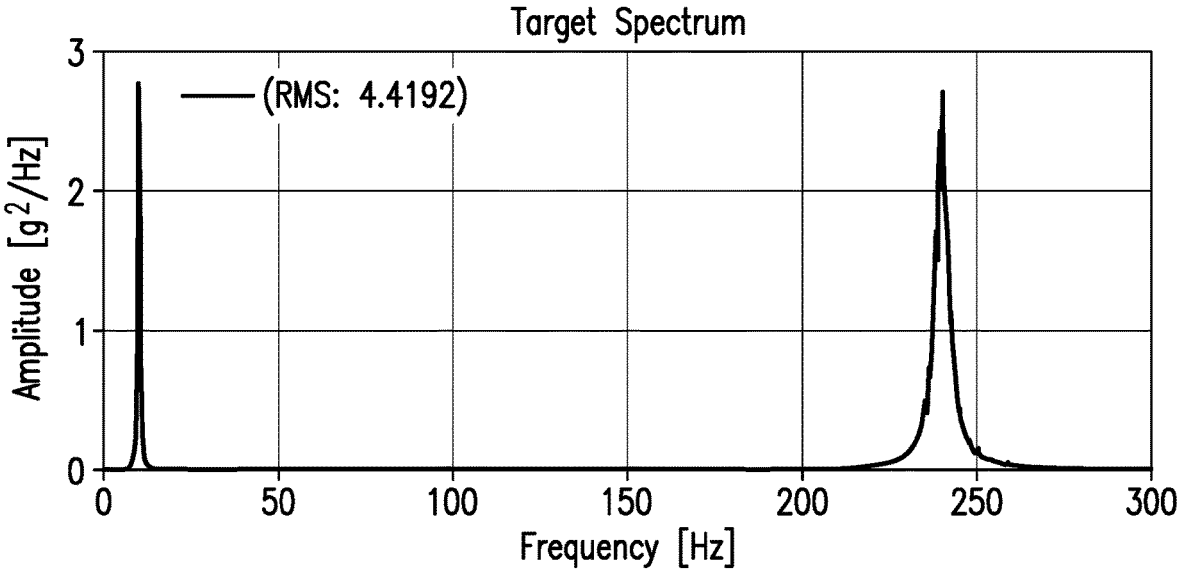
FIG. 9 is a plot of a target spectrum obtained from an ensemble of one hundred time records.

Turning to FIG. 8, an assumed measured downhole dynamic event data is plotted having the shown characteristics. The downhole dynamic event data, which in this example is vibration data, has two distinct frequencies around 10 Hz and 240 Hz, as evidenced by the sample spectrum plot of FIG. 8. These distinct frequencies become more noticeable in the averaged spectrum of the ensemble shown in the plot of FIG. 9. The plot of FIG. 9 represents the target spectrum for downhole dynamic processes.

The auto-covariance values are determined from Equation (7). From the auto-covariance values, the linear system is generated to form the partitioned R matrix defined by Equations (12)-(14) and the ARMA-coefficient vector. Upon solving the system of Equation (12), the ARMA-coefficients are obtained and the approximation spectrum is generated using Equation (11).

Figure 10:
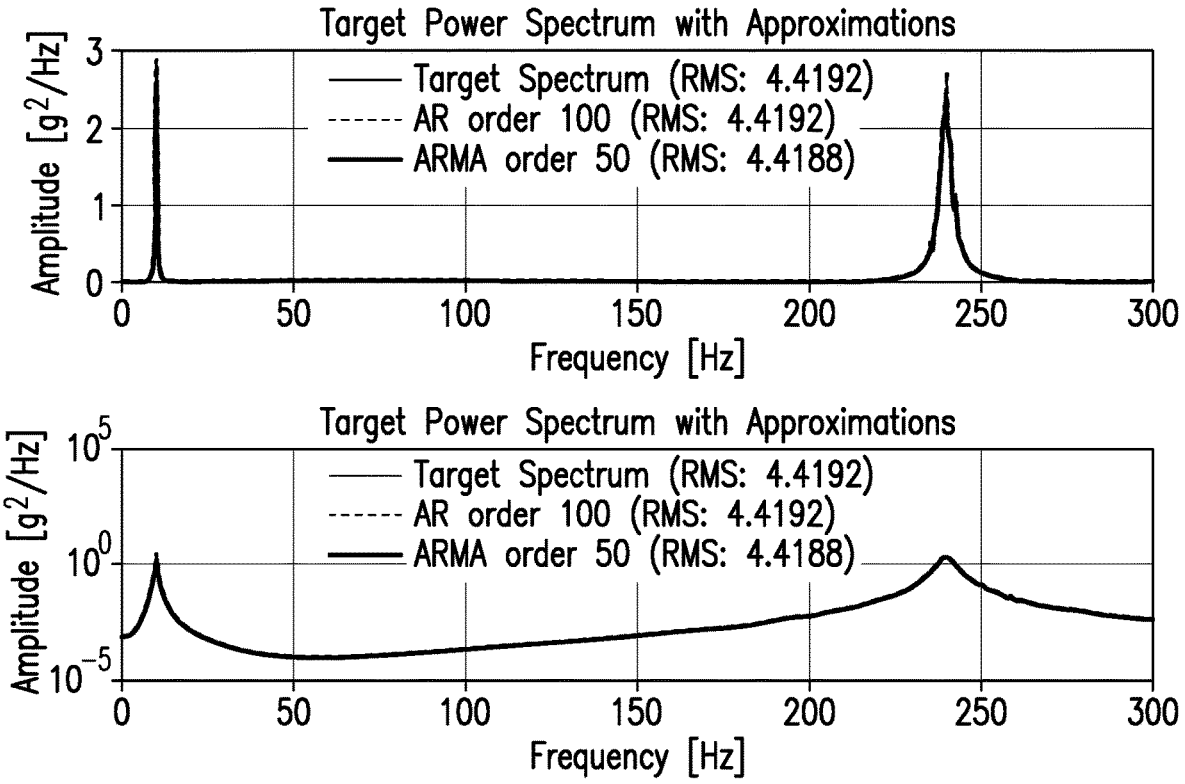
FIG. 10 is a pair of plots of a target spectrum and approximation spectra and a Log scale plot of a target spectrum and approximation spectra in accordance with an embodiment of the present disclosure.

FIG. 10 illustrates the approximating capability of the AR- and ARMA-methods to the target spectrum. FIG. 10 is a plot of a target spectrum and approximation spectra from digital filters and a Log scale plot of a target spectrum and approximation spectra. FIG. 10 indicates that the approximation spectrum is substantially accurate in recreating the target spectrum from the downhole dynamic event data, and thus the main characteristics of the downhole dynamic event can be preserved through the processes described herein. As is apparent from FIG. 10, both of the dominant peaks, at 10 Hz and 240 Hz, are identifiable and the rms values are within 1% of the target rms value. In addition to the approximation spectrum, the ARMA-coefficients are utilized to synthesize artificial time histories using Equation (15).

Figure 11:
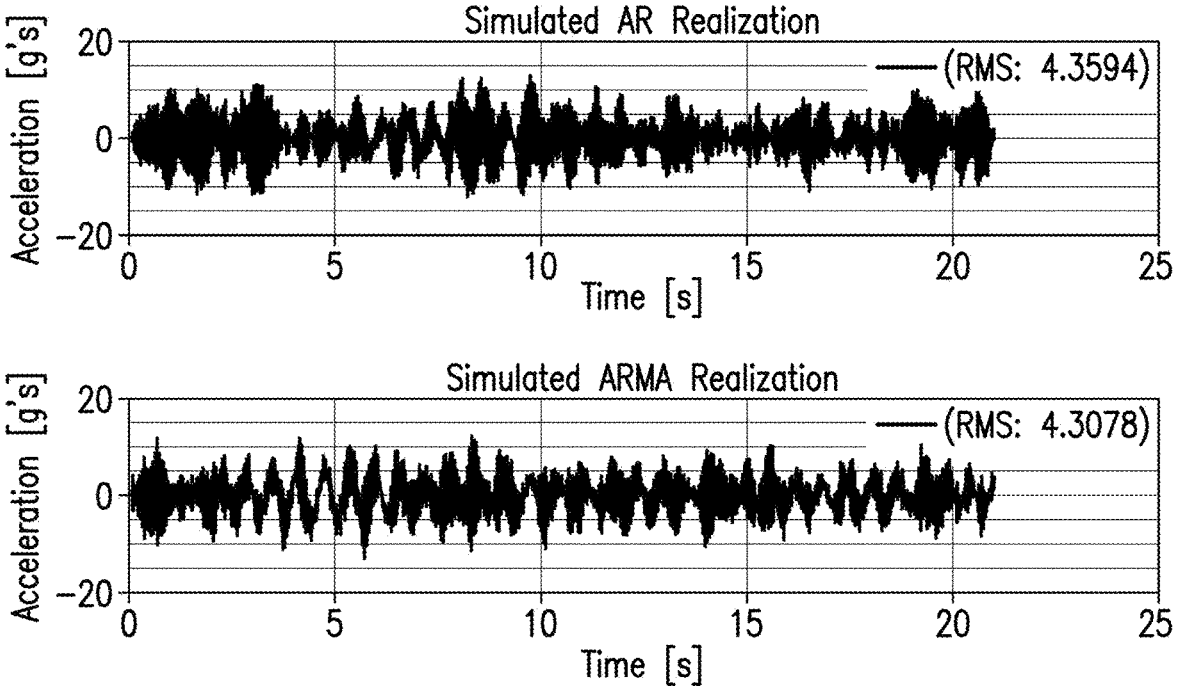
FIG. 11 is a pair of plots illustrating compatible time histories synthesized from digital filter coefficients in accordance with embodiments of the present disclosure.
Figure 12:
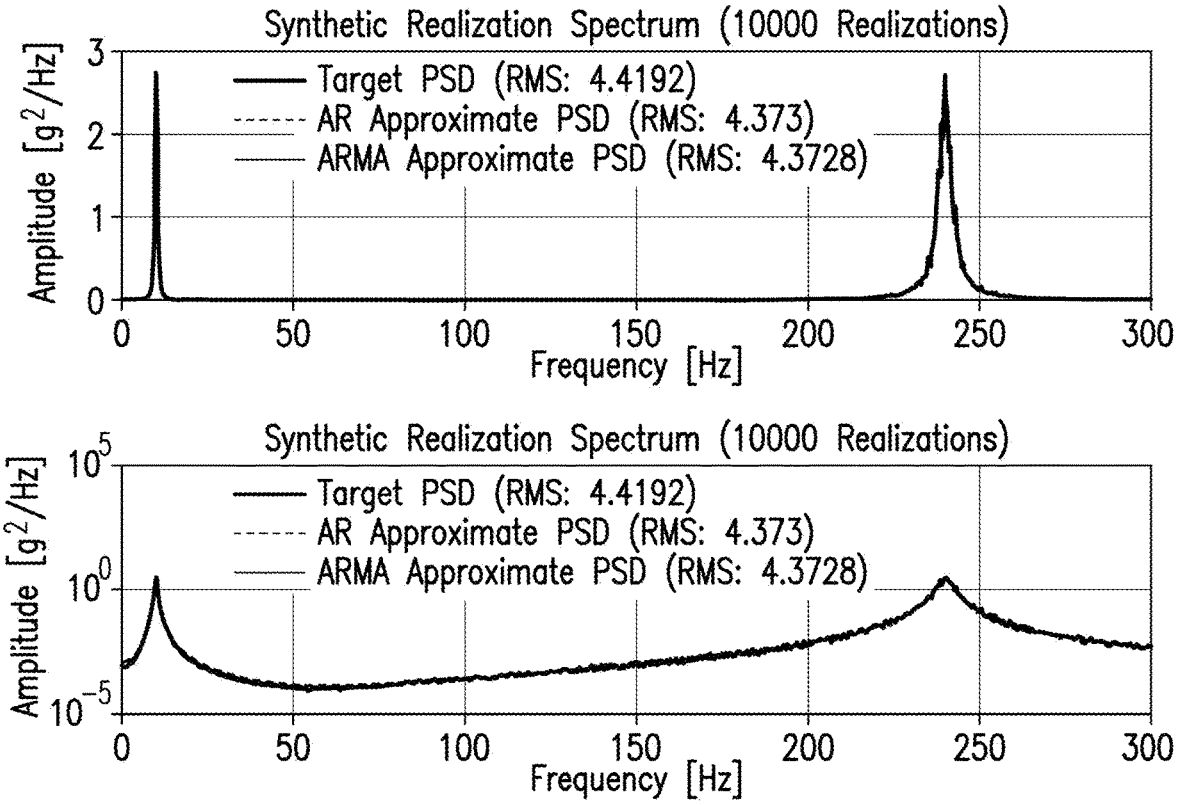
FIG. 12 is a pair of plots illustrating spectra of synthetic realizations compared to a target spectrum in accordance with an embodiment of the present disclosure.

FIG. 11 illustrates the synthetic time histories generated using the AR-algorithm of Equation (10) and the ARMA-algorithm of Equation (15). That is, FIG. 11 illustrates compatible time histories synthesized from digital filter coefficients. It is clear from FIG. 11 that the synthetic time histories exhibit peak acceleration values similar to the peak values of the actual time history in FIG. 8 (between 10-15 g's). Additionally, the rms values of the time histories is within 5% of the target rms value in FIG. 9. The time histories are compatible with the target spectrum. To sufficiently verify the compatibility of the synthetic time histories with the target spectrum, the spectra of the synthetic time histories can be compared with the original spectrum of the target spectrum, as shown in FIG. 12. The spectra are computed from an ensemble of 10,000 synthetic time histories and the averaged spectrum from these time histories is illustrated in FIG. 12. Again, both peaks are clearly evident and the spectra match well with the original spectrum. The rms values of the spectra are within 1% of the target spectrum rms value, which is similar to the approximation spectra in FIG. 10. This verifies that the synthetic time histories are compatible with the target spectrum and provide an accurate approximation to the target spectrum provided a sufficient number of synthetic time histories are used within the ensemble.

In addition to enabling extraction of downhole dynamic events to enable adjustments to a drilling or other downhole operation, embodiments provided herein can be used to predict tool life downhole. For example, as described below, a single-degree-of-freedom (SDOF) example is provided. This example demonstrates real-time studies that may be performed to predict tool life downhole. To determine a response of a SDOF system, a Monte Carlo approach is performed. Realizations generated from the ARMA-algorithm in Equation (15), and compatible with the target spectrum of FIG. 9, are provided as the system input (e.g., excitation). The response of the systems is found through direct time integration using the Newmark-Beta method. The process is repeated for a predetermined number of realizations. Statistical parameters of the response are determined to give insight into the expected system response.

Figure 13:
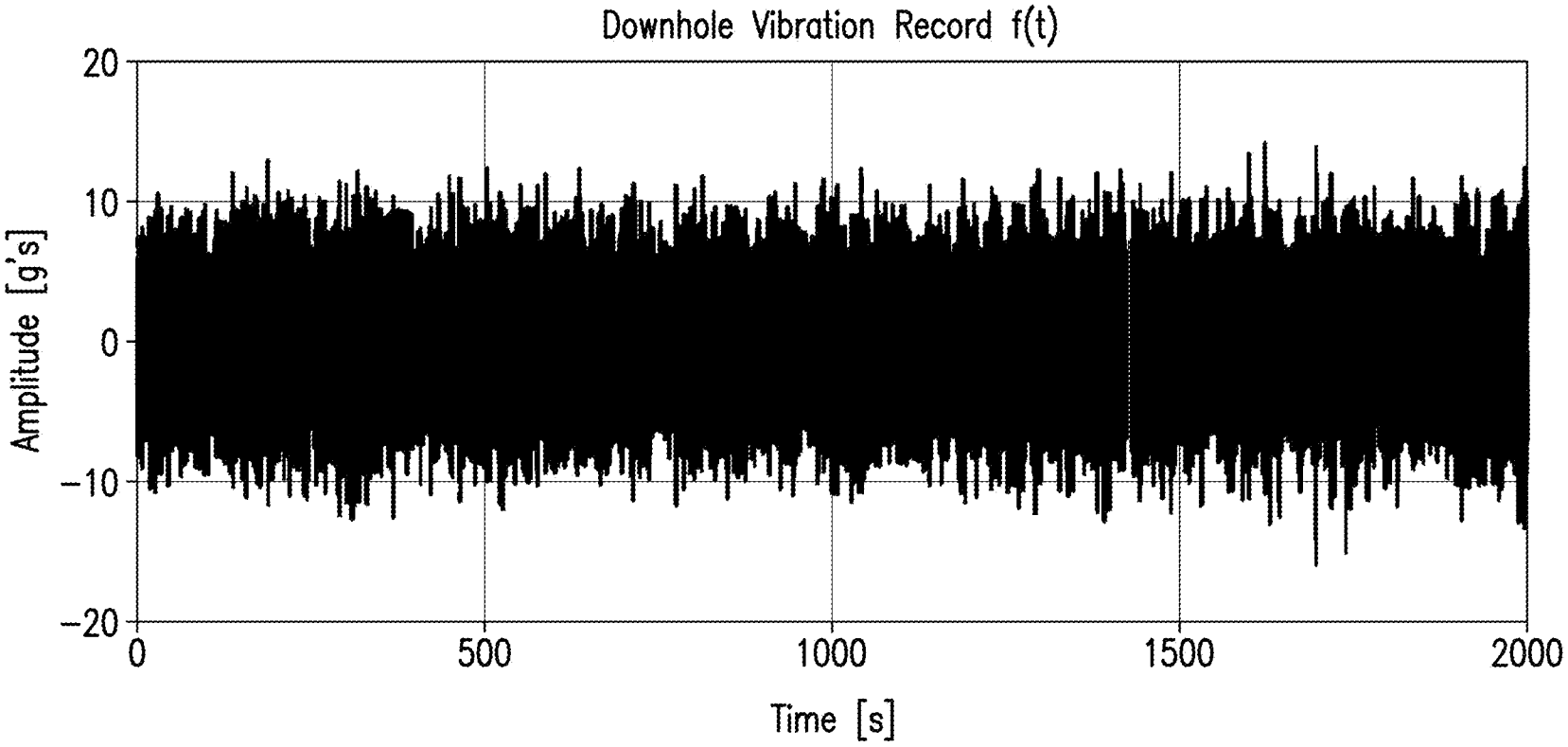
FIG. 13 is a plot of an example of downhole dynamic event data obtained downhole.
Figure 14:
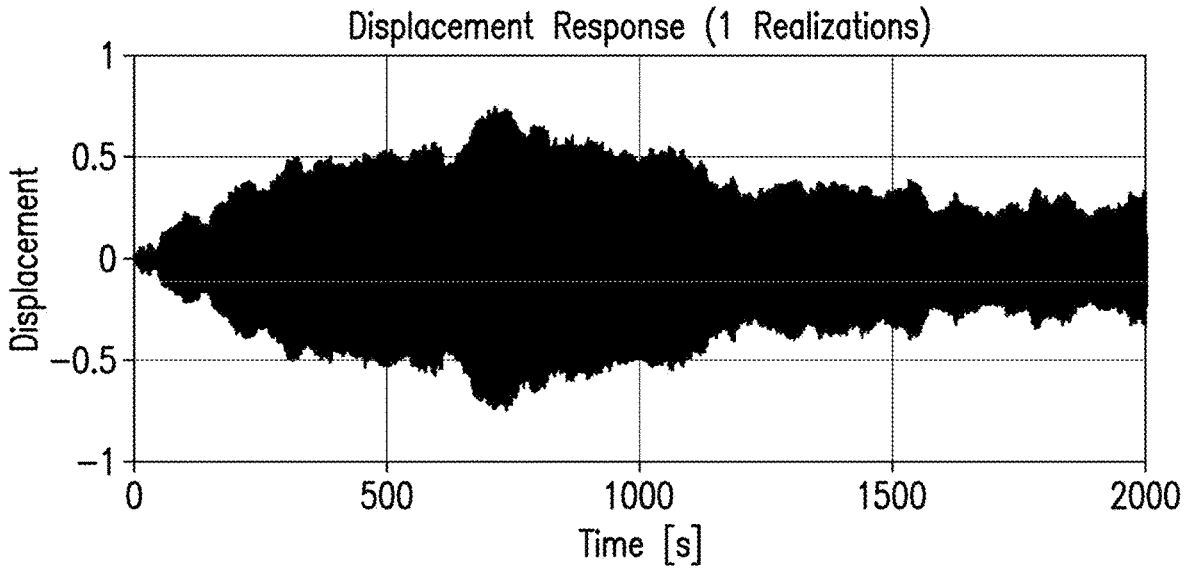
FIG. 14 is a plot of a displacement response resulting from a single compatible realization.
Figure 15:
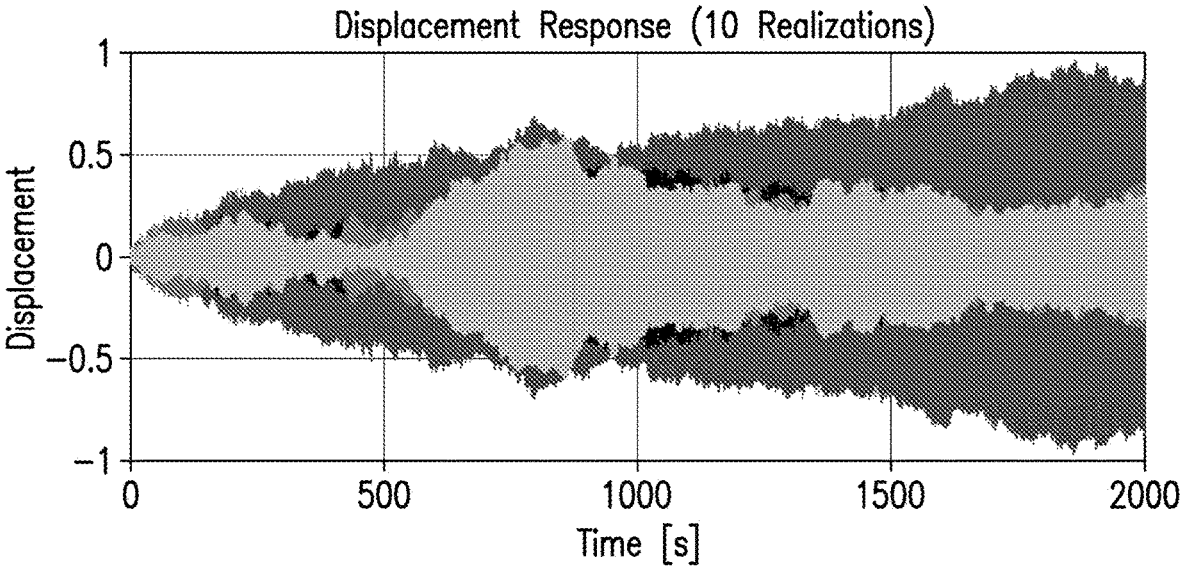
FIG. 15 is a plot of displacement responses resulting from ten compatible realizations.
Figure 16:
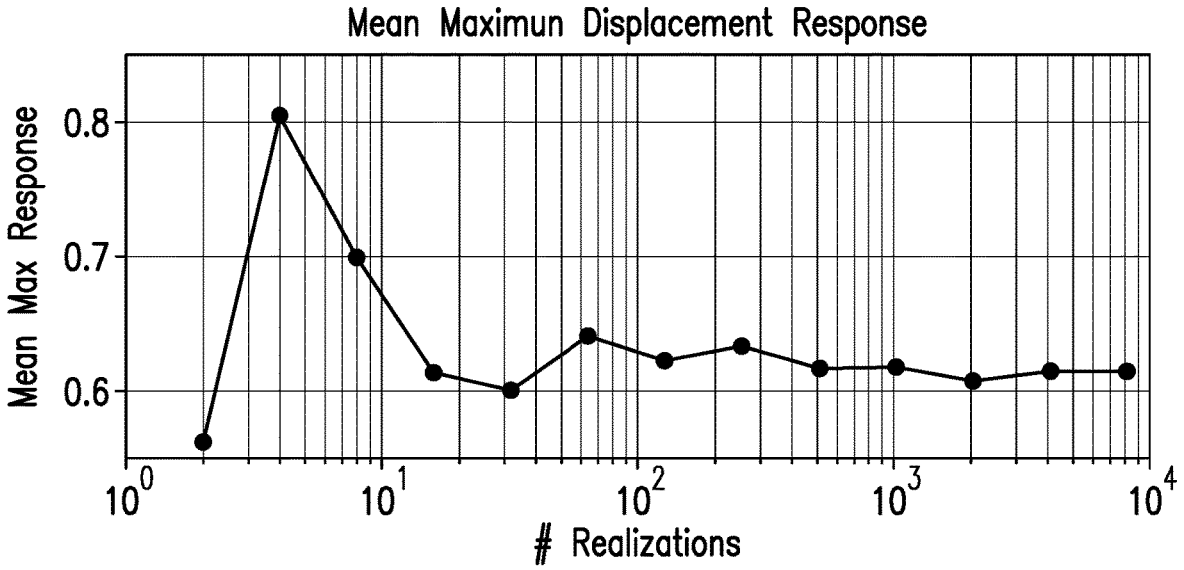
FIG. 16 is a plot of mean maximum displacement response from simulations with doubling realizations.
Figure 17:
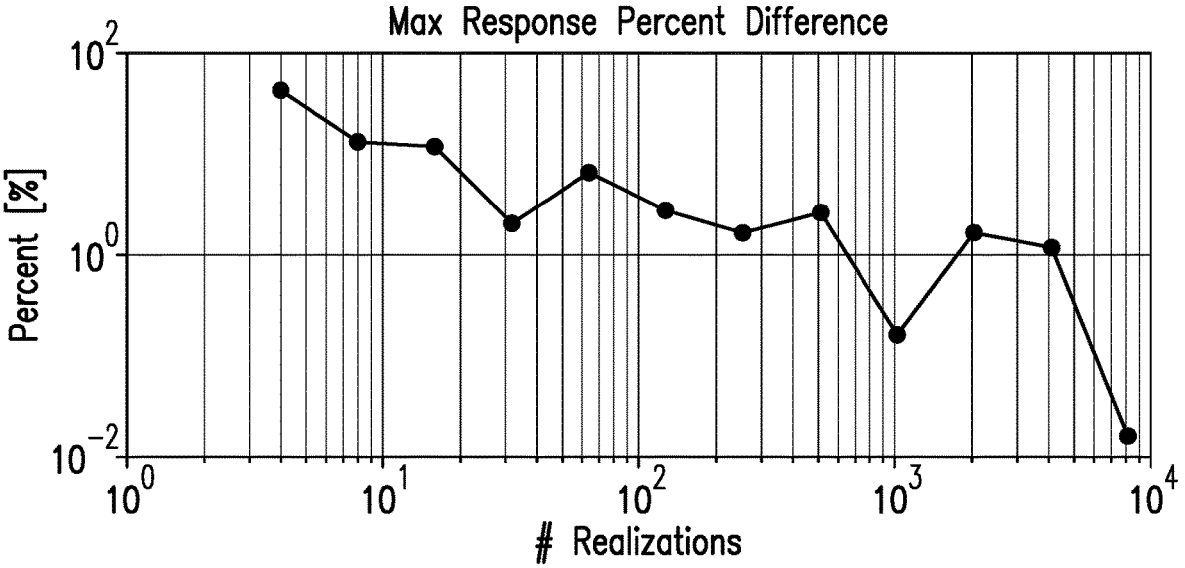
FIG. 17 is a plot of percent difference of mean max response between simulations with doubling realizations.
Figure 18:
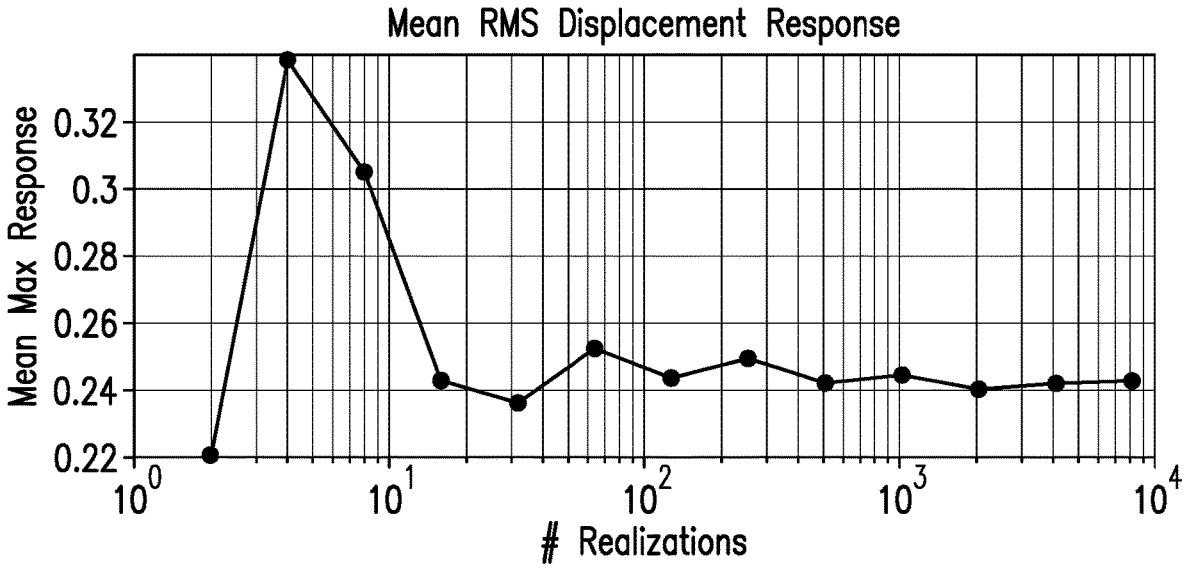
FIG. 18 is a pot of mean root-mean-square displacement response form simulations with doubling realizations.
Figure 19:
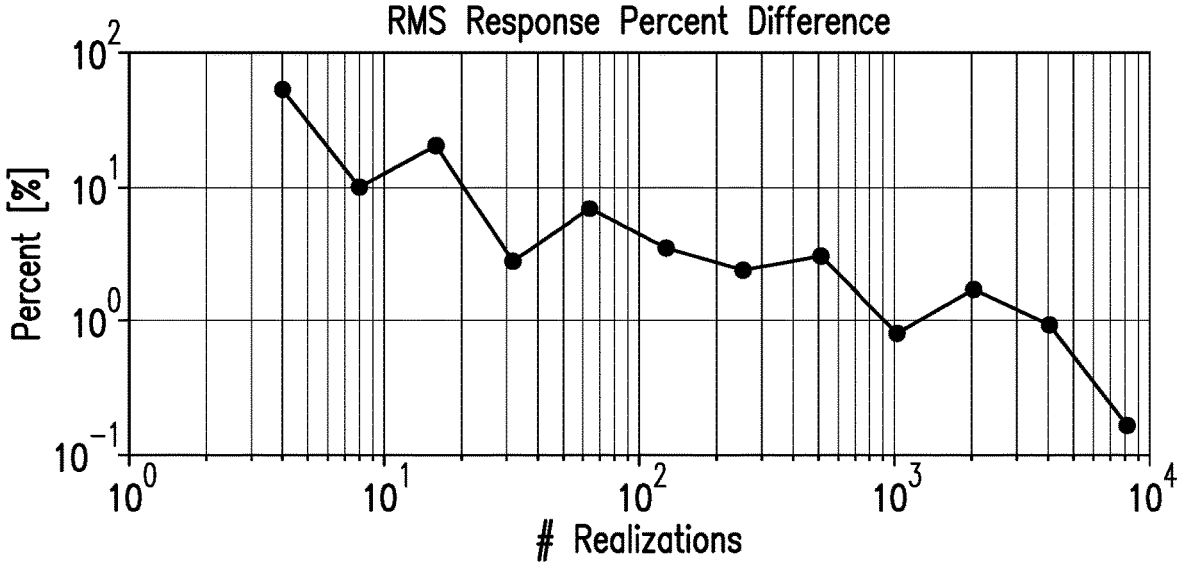
FIG. 19 is a plot of percent difference of mean max response between simulations with doubling realizations.

FIG. 13 is an example excitation time history compatible with the target spectrum illustrated in FIG. 9. After applying the excitation time history, the displacement response is computer for the entire ensemble of excitation time histories. This response, shown in FIG. 14, illustrates the deflection of the system from a single excitation. That is, FIG. 14 illustrates an SDOF oscillator displacement response to one compatible realization. FIG. 15 shows the variation in maximum displacement from an ensemble of ten realizations. Monte Carlo simulations for various numbers of realizations are employed to demonstrate that as the number of realizations increases, the statistical mean converges. FIG. 16 shows the mean of the maximum displacements from all of the calculated responses for ensembles that double with every simulation (e.g., 2, 4, 8, etc.). Convergence about the mean displacement is clear and further evidenced in FIG. 17, which is the percent difference from one simulation to the next. Similarly, the mean of the rms displacement response is shown in FIG. 18 and, again, the trend in FIG. 19 shows convergence as the ensemble increases in number.

Figure 20:
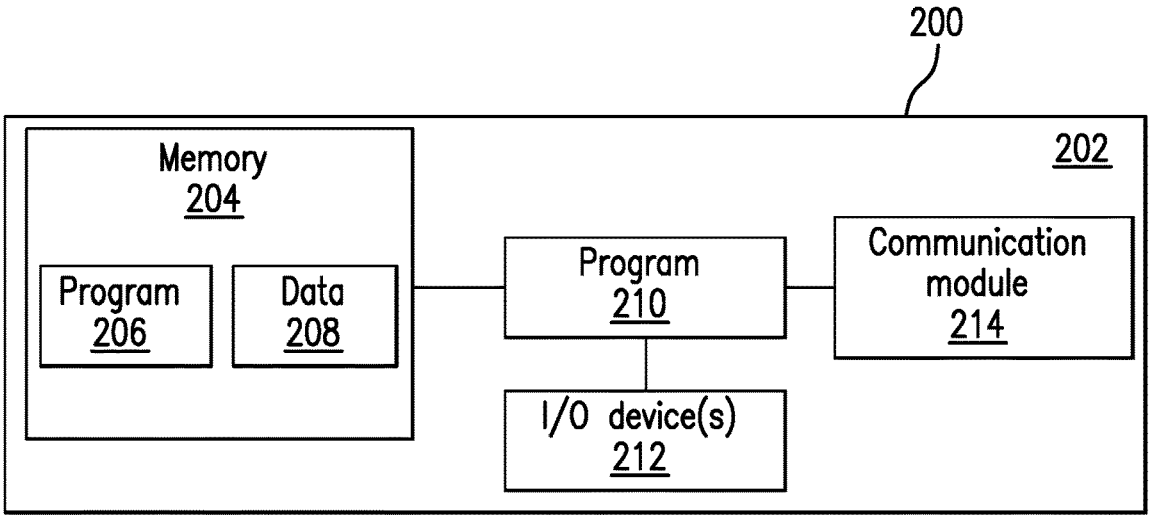
FIG. 20 is a schematic diagram of a downhole computing system in accordance with an embodiment of the present disclosure.

Turning now to FIG. 20, a schematic block diagram illustration of an example computing system 202 of a downhole tool 200 is shown. Although described with respect to a downhole tool 200, those of skill in the art will appreciate that the computing system 202 as described herein can be representative of a remote computing system, a surface controller, a downhole controller, etc., and thus the present discussion is not to be limiting. The computing system 202 may be representative of computing elements or components of various downhole tools, including, but not limited to a BHA. The computing system 202 can be configured to operate and/or control one or more downhole tools and/or components and/or receive data from one or more downhole tools, components, sensors, monitoring devices, etc. as will be appreciated by those of skill in the art.

As shown, the computing system 202 includes a memory 204 which may store executable instructions and/or data. The executable instructions may be stored or organized in any manner and at any level of abstraction, such as in connection with one or more applications, apps, programs, processes, routines, procedures, methods, etc. As an example, at least a portion of the instructions are shown in FIG. 20 as being associated with one or more programs 206. The memory 204 can include RAM and/or ROM and can store one or more programs 206 thereon, wherein the program(s) 206 may be an operating system, operating system components, applications, etc. to be executed downhole, e.g., using the downhole tool 200.

Further, the memory 204 may store data 208. The data 208 may include device identifier data, pre-stored algorithms for executing by the program 206, or any other type(s) of data as will be appreciated by those of skill in the art. The executable instructions stored in the memory 204 may be executed by one or more processors, such as a processor 210, which may be a processor of the downhole tool 200. The processor 210 may be operative on the data 208 and/or configured to execute the program 206. In some embodiments, the executable instructions can be performed using a combination of the processor 210 and remote resources (e.g., data and/or programs stored on other downhole tools, located at the surface, or combinations thereof). The processor 210 may be coupled to one or more input/output (I/O) devices 212. In some embodiments, the I/O device(s) 212 may include one or more remote sensors and/or monitoring elements arranged to provide detected and/or recorded data to the computing system 202.

The components of the computing system 202 may be operably and/or communicably connected by one or more buses. The computing system 202 may further include other features or components as known in the art. For example, the computing system 202 may include one or more communication modules 214, e.g., transceivers and/or devices configured to receive information or data from sources external to the computing system 202. In one non-limiting embodiments, the communication module 214 of the downhole tool 200 can be arranged to transmit data through mud-pulse telemetry, acoustic telemetry, electro-magnetic telemetry, optical telemetry, wired pipe telemetry, or other downhole communication techniques.

The computing systems 202 may be used to execute or perform embodiments and/or processes described herein, such as within downhole tools to monitor downhole dynamic events, obtain downhole dynamic events data, and extract digital filter coefficients for transmission to remote computing systems, e.g., at the surface, such that the downhole dynamic events data can be reconstructed in near-real-time. In some embodiments, the memory 204 can be arranged to store digital filter coefficients as generated in accordance with embodiments of the present disclosure. Thus, the data 208 can include digital filter coefficients as described herein. The digital filter coefficients can be stored for later extraction from the memory 204 and then processing, as described herein, to reconstruct time-domain data.

Figure 21:
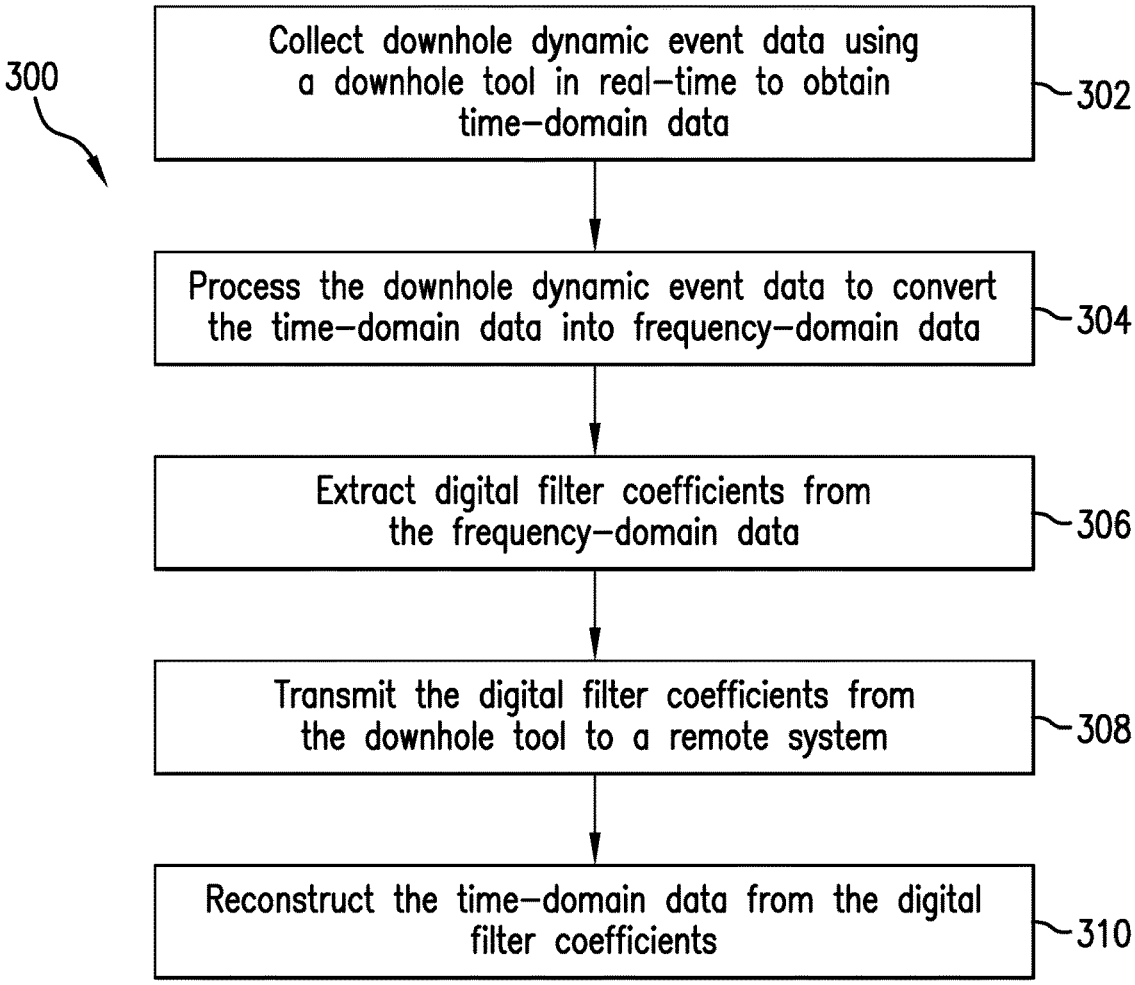
FIG. 21 is a flow process in accordance with an embodiment of the present disclosure.

Turning now to FIG. 21, a flow process 300 in accordance with an embodiment of the present disclosure is shown. The flow process 300 is designed to enable near-real-time extraction of time-domain data associated with downhole events and/or conditions in an efficient and accurate process at a remote computing system. Thus, the flow process 300 can be used to enable an operator to make near-real-time decisions based on actual and/or active conditions to adjust a downhole operation (e.g., drilling operation) and/or to determine or estimate the life of the downhole tools to prevent damage and/or downtime.

At block 302, a downhole tool is used to obtain or collect downhole dynamic event data. The downhole dynamic event data is time-domain data that is collected in real-time by one or more sensors, monitoring devices, instruments, etc. The downhole dynamic event data, in some examples, may be vibration data, torque data, bending moment data, etc. that is associated with one or more downhole tools.

At block 304, a processor located downhole receives the time-domain data to process the downhole dynamic event data to convert the time-domain data into frequency-domain data in accordance with embodiments of the present disclosure.

At block 306, the processor will extract one or more digital filter coefficients from the frequency-domain data. The process may be similar to that described above. The digital filter coefficients may be Auto-regressive (AR), Moving-average (MA), Auto-regressive Moving-average (ARMA), Fast-Fourier Transform (FFT), or other digital filter coefficients.

At block 308, the digital filter coefficients are transmitted from the downhole tool to the remote computing system. The transmission may be by mud-pulse telemetry, acoustic telemetry, electro-magnetic telemetry, optical telemetry, wired pipe telemetry, or other downhole communication techniques. The digital filter coefficients are received at a remote computing system, such as a surface controller or computing system, although other remote computing systems may be employed, such as located at other locations along a drill string or within a downhole tool.

Alternatively or in addition to the transmission of block 308, the flow process can include storing the digital filter coefficients in memory of the downhole tool. In such embodiments, prior to block 310, the downhole tool can be tripped from a borehole, enabling extraction of the stored digital filter coefficients from the memory at a remote computing system.

At block 310, the remote computing system will reconstruct the spectrum of the downhole dynamic event and the time-domain data from the digital filter coefficients, as described above. For example, reconstruction can be performed using recursive algorithms, as described above.

From the reconstructed spectrum and the time-domain data, an operator may then understand current downhole conditions and/or events, and thus take appropriate action in response to the known downhole conditions/events.

As discussed above, current downhole dynamic measurements are evaluated only post-drilling. Downhole dynamic event data (e.g., vibration data) is typically too voluminous to transmit in real-time to the remote computing system. However, transmitting spectral content, such as digital filter coefficients as provided herein, is efficient. That is, the frequency-domain content of digital filters is compressed as compared to time-domain content. Embodiments provided herein of used one or more types of digital filters (e.g., AR, MA, ARMA, FFT, etc.) condenses the time-domain information into compact and easily transmittable sets of coefficients from the digital filters. Once the filter coefficients are obtained at the remote computing system, recursive algorithms can be used to recreate the target spectrum via sufficiently accurate approximation spectra of the downhole dynamic event (e.g., reconstruction of the downhole dynamic event data).

In addition to spectral content, artificial realization may be generated from the digital filter coefficients. The realizations are compatible with the downhole spectra and may be used for qualification studies and/or diagnostic/prognostic analysis during downhole operations (e.g., drilling operations, production operations, etc.). For example, such analysis may be obtained through performing Monte Carlo simulations.

Advantageously, embodiments provided herein are directed to enabling real-time or near-real-time downhole dynamic event monitoring in a way that elucidates current downhole conditions. Spectral content may be correlated to a severity of downhole dynamic event(s) lithological changes, system changes (e.g., wear/damage), or can be used to determine other factors associated with downhole conditions, environments, and/or downhole tool operations. Accordingly, advantageously, real-time information can provide for improved decision-making by operators (human or automated, as will be appreciated by those of skill in the art). For example, improved decisions can be made with respect to drilling operations, optimization of drilling operations is possible, reductions in non-productive time can be achieved, and increases in time-in-reservoir are possible.

Advantageously, from a drilling perspective, embodiments provided herein can enable faster drilling, staying in pay-zones longer, and reducing downtime. For example, drilling vibration measurements have been shown to impact operational efficiencies. Severe vibration conditions can reduce rate-of-penetration and limit drilling speed. Understanding spectral content of drilling vibration in real-time allows an operator to adjust drilling parameters rapidly and avoid dangerous phenomena. Vibration data may also be correlated to formation properties. As such, when coupling the information obtained in accordance with embodiments of the present disclosure with traditional sensor measurements, more precise geo-steering can be achieved. Moreover, having access to the spectral changes real-time can provide indications when a drill bit crosses over zones or interfaces different lithological features. The ability to geo-steer from spectral vibration ensures more time in the reservoir. Further, advantageously, artificial vibration realizations may be used to run on-surface studies to predict the life of the downhole tools to prevent damage and downtime.

Embodiment 1

A method of conducting downhole operations, the method comprising: collecting downhole dynamic event data using a downhole tool, wherein the downhole dynamic event data is time-domain data; processing the collected downhole dynamic event data using a computing system located downhole to convert the time-domain data into frequency-domain data; and extracting digital filter coefficients from the frequency-domain data.

Embodiment 2

The method of any embodiment described herein, further comprising: transmitting the digital filter coefficients from the downhole computing system to a remote computing system; and reconstructing, with the remote computing system, at least one of downhole dynamic event spectrum and the time-domain data using the digital filter coefficients.

Embodiment 3

The method of any embodiment described herein, wherein transmission of the digital filter coefficients comprises one of mud-pulse telemetry, acoustic telemetry, electro-magnetic telemetry, optical telemetry, and wired pipe telemetry.

Embodiment 4

The method of any embodiment described herein, further comprising performing at least one of lithology detection, geo-steering, downhole tool diagnostic evaluation, downhole tool prognostic evaluation, and downhole tool life/wear evaluation based on the reconstructed time-domain data.

Embodiment 5

The method of any embodiment described herein, wherein the downhole tool diagnostic evaluation, the downhole tool prognostic evaluation, and the downhole tool life/wear evaluation comprise Monte Carlo simulations.

Embodiment 6

The method of any embodiment described herein, further comprising adjusting a drilling operation based on the reconstructed time-domain data.

Embodiment 7

The method of any embodiment described herein, wherein the collection of downhole dynamic event data, the transmission of the digital filter coefficients, and the reconstruction of at least one of the downhole dynamic event spectrum and the time-domain data occur during a drilling operation.

Embodiment 8

The method of any embodiment described herein, further comprising: storing the digital filter coefficients at the downhole computing system; retrieving the downhole computing system from downhole; extracting the digital filter coefficients from the downhole computing system with a remote computing system; and reconstructing, with the remote computing system, at least one of downhole dynamic event spectrum and the time-domain data using the digital filter coefficients.

Embodiment 9

The method of any embodiment described herein, wherein the digital filter coefficients are at least one of Auto-regressive (AR) coefficients, Moving-average (MA) coefficients, Auto-regressive Moving-average (ARMA) coefficients, and Fast-Fourier Transform coefficients.

Embodiment 10

The method of any embodiment described herein, wherein the digital filter coefficients are a combination of at least two of Auto-regressive (AR) coefficients, Moving-average (MA) coefficients, and Auto-regressive Moving-average (ARMA) coefficients Embodiment 11

The method of any embodiment described herein, wherein the downhole dynamic event data is vibration data of a vibration of a downhole tool.

Embodiment 12

A system for conducting downhole operations, the system comprising: a downhole tool disposed in a borehole, the downhole tool arranged to perform a downhole operation; and a downhole computing system configured to: collect downhole dynamic event data form the downhole tool, wherein the downhole dynamic event data is time-domain data; process the collected downhole dynamic event data to convert the time-domain data into frequency-domain data; and extract digital filter coefficients from the frequency-domain data.

Embodiment 13

The system of any embodiment described herein, further comprising: a remote computing system arranged in communication with the downhole tool, wherein the downhole computing system is configured to transmit the digital filter coefficients from the downhole computing system to the remote computing system, and wherein the remote computing system is configured to reconstruct at least one of downhole dynamic event spectrum and the time-domain data using the digital filter coefficients.

Embodiment 14

The system of any embodiment described herein, wherein transmission of the digital filter coefficients comprises one of mud-pulse telemetry, acoustic telemetry, electro-magnetic telemetry, optical telemetry, and wired pipe telemetry.

Embodiment 15

The system of any embodiment described herein, wherein the downhole operation is adjusted based on the reconstructed time-domain data.

Embodiment 16

The system of any embodiment described herein, wherein the remote computing system is configured to perform at least one of lithology detection, geo-steering, downhole tool diagnostic evaluation, downhole tool prognostic evaluation, and downhole tool life/wear evaluation based on the reconstructed time-domain data.

Embodiment 17

The system of any embodiment described herein, wherein the downhole tool diagnostic evaluation, the downhole tool prognostic evaluation, and the downhole tool life/wear evaluation comprise Monte Carlo simulations.

Embodiment 18

The system of any embodiment described herein, wherein the collection of downhole dynamic event data, the transmission of the digital filter coefficients, and the reconstruction of the time-domain data occur during the drilling operation.

Embodiment 19

The system of any embodiment described herein, wherein the digital filter coefficients are at least one of Auto-regressive (AR) coefficients, Moving-average (MA) coefficients, Auto-regressive Moving-average (ARMA) coefficients, and Fast-Fourier Transform coefficients.

Embodiment 20

The system of any embodiment described herein, the downhole computing system configured to store the digital filter coefficients at the downhole computing system, wherein the system further comprises: a remote computing system arranged to extract the digital filter coefficients from the downhole computing system and reconstruct at least one of downhole dynamic event spectrum and the time-domain data using the digital filter coefficients.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively, or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The flow diagram(s) depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A method of conducting downhole operations, the method comprising:

collecting downhole dynamic event data using a control element of a downhole tool, wherein the downhole dynamic event data is time-domain data and the downhole tool is disposed in a borehole;

processing the collected downhole dynamic event data using a downhole computing system located downhole that is operably connected to the control element, the computing system configured to convert the time-domain data into frequency-domain data; and extracting digital filter coefficients from the frequency-domain data to enable reconstruction of at least one of downhole dynamic event spectrum and the time-domain data.

2. The method of claim 1, further comprising:

transmitting the digital filter coefficients from the downhole computing system to a remote computing system; and reconstructing, with the remote computing system, at least one of the downhole dynamic event spectrum and the time-domain data using the digital filter coefficients.

3. The method of claim 2, wherein transmission of the digital filter coefficients comprises one of mud-pulse telemetry, acoustic telemetry, electro-magnetic telemetry, optical telemetry, and wired pipe telemetry.

4. The method of claim 2, further comprising performing at least one of lithology detection, geo-steering, downhole tool diagnostic evaluation, downhole tool prognostic evaluation, and the downhole tool life/wear evaluation based on the reconstructed time-domain data.

5. The method of claim 4, wherein the downhole tool diagnostic evaluation, the downhole tool prognostic evaluation, and the downhole tool life/wear evaluation comprise Monte Carlo simulations.

6. The method of claim 2, further comprising adjusting a drilling operation based on the reconstructed time-domain data.

7. The method of claim 2, wherein the collection of downhole dynamic event data, the transmission of the digital filter coefficients, and the reconstruction of at least one of the downhole dynamic event spectrum and the time-domain data occur during a drilling operation.

8. The method of claim 1, further comprising:

storing the digital filter coefficients at the downhole computing system;

retrieving the downhole computing system from downhole;

extracting the digital filter coefficients from the downhole computing system with a remote computing system; and reconstructing, with the remote computing system, at least one of downhole dynamic event spectrum and the time-domain data using the digital filter coefficients.

9. The method of claim 1, wherein the digital filter coefficients are at least one of Auto-regressive (AR) coefficients, Moving-average (MA) coefficients, Auto-regressive Moving-average (ARMA) coefficients, and Fast-Fourier Transform coefficients.

10. The method of claim 1, wherein the digital filter coefficients are a combination of at least two of Auto-regressive (AR) coefficients, Moving-average (MA) coefficients, and Auto-regressive Moving-average (ARMA) coefficients.

11. The method of claim 1, wherein the downhole dynamic event data is vibration data of a vibration of a downhole tool.

12. A system for conducting downhole operations, the system comprising:

a downhole tool disposed in a borehole, the downhole tool arranged to perform a downhole operation; and a downhole computing system configured to:

collect downhole dynamic event data from the downhole tool, wherein the downhole dynamic event data is time-domain data;

process the collected downhole dynamic event data to convert the time-domain data into frequency-domain data; and extract digital filter coefficients from the frequency-domain data.

13. The system of claim 12, further comprising:

a remote computing system arranged in communication with the downhole tool, wherein the downhole computing system is configured to transmit the digital filter coefficients from the downhole computing system to the remote computing system, and wherein the remote computing system is configured to reconstruct at least one of downhole dynamic event spectrum and the time-domain data using the digital filter coefficients.

14. The system of claim 13, wherein transmission of the digital filter coefficients comprises one of mud-pulse telemetry, acoustic telemetry, electro-magnetic telemetry, optical telemetry, and wired pipe telemetry.

15. The system of claim 13, wherein the downhole operation is adjusted based on the reconstructed time-domain data.

16. The system of claim 13, wherein the remote computing system is configured to perform at least one of lithology detection, geo-steering, downhole tool diagnostic evaluation, downhole tool prognostic evaluation, and downhole tool life/wear evaluation based on the reconstructed time-domain data.

17. The system of claim 16, wherein the downhole tool diagnostic evaluation, the downhole tool prognostic evaluation, and the downhole tool life/wear evaluation comprise Monte Carlo simulations.

18. The system of claim 13, wherein the collection of downhole dynamic event data, the transmission of the digital filter coefficients, and the reconstruction of the time-domain data occur during the downhole operation.

19. The system of claim 12, wherein the digital filter coefficients are at least one of Auto-regressive (AR) coefficients, Moving-average (MA) coefficients, Auto-regressive Moving-average (ARMA) coefficients, and Fast-Fourier Transform coefficients.

20. The system of claim 12, the downhole computing system configured to store the digital filter coefficients at the downhole computing system, wherein the system further comprises:

a remote computing system arranged to extract the digital filter coefficients from the downhole computing system and reconstruct at least one of downhole dynamic event spectrum and the time-domain data using the digital filter coefficients.

* * * * *